US011474476B2

(12) United States Patent
Johnson, Jr. et al.

(10) Patent No.: US 11,474,476 B2
(45) Date of Patent: Oct. 18, 2022

(54) ELECTRICAL CONNECTOR ASSEMBLY FOR AN IMAGE FORMING DEVICE

(71) Applicant: LEXMARK INTERNATIONAL, INC., Lexington, KY (US)

(72) Inventors: Virgil Johnson, Jr., Versailles, KY (US); Darren Adam Keese, Lexington, KY (US); James Richard Leemhuis, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/236,490

(22) Filed: Apr. 21, 2021

(65) Prior Publication Data

US 2021/0333739 A1 Oct. 28, 2021

Related U.S. Application Data

(60) Provisional application No. 63/014,797, filed on Apr. 24, 2020.

(51) Int. Cl.

| | |
|---|---|
| ***G03G 15/00*** | (2006.01) |
| ***G03G 21/16*** | (2006.01) |
| ***G03G 15/08*** | (2006.01) |

(52) U.S. Cl.

CPC ..... *G03G 21/1652* (2013.01); *G03G 15/087* (2013.01); *G03G 15/0863* (2013.01); *G03G 15/80* (2013.01)

(58) Field of Classification Search

USPC ..... 399/90

See application file for complete search history.

(56) References Cited

U.S. PATENT DOCUMENTS 7,978,997 B2 7/2011 Tokuda
8,938,179 B2 1/2015 Amann et al.
(Continued)

FOREIGN PATENT DOCUMENTS

EP 3086181 A1 10/2016
ES 2719175 T3 * 7/2019 ..... G03G 15/08
(Continued)

OTHER PUBLICATIONS

U.S. Appl. No. 17/152,211, filed Jan. 19, 2021 (Amann et al.).
(Continued)

*Primary Examiner* — Quana Grainger

(57) ABSTRACT

An assembly for an image forming device includes an access door movable between an open position permitting replacement of a replaceable unit and a closed position. An electrical connector in the image forming device is movable between a retracted position and an extended position. In the retracted position the electrical connector is disengaged from a corresponding electrical connector of the replaceable unit when the replaceable unit is installed in the image forming device. In the extended position the electrical connector is engaged with the corresponding electrical connector of the replaceable unit. The electrical connector is operatively connected to the access door such that movement of the access door from the closed to the open position moves the electrical connector from the extended to the retracted position and movement of the access door from the open to the closed position moves the electrical connector from the retracted to the extended position.

18 Claims, 21 Drawing Sheets

(56) References Cited

U.S. PATENT DOCUMENTS

| | | | |
|---|---|---|---|
| 9,551,974 | B1 | 1/2017 | Martin et al. |
| 9,563,169 | B1 | 2/2017 | Carpenter et al. |
| 10,018,960 | B2 | 7/2018 | Itabashi |
| 10,025,264 | B1 | 7/2018 | Itabashi |
| 10,042,282 | B2 | 8/2018 | Itabashi |
| 10,101,706 | B2 | 10/2018 | Yokoi |
| 10,175,637 | B2 | 1/2019 | Nishiyama et al. |
| 10,649,389 | B1 | 5/2020 | Carpenter et al. |
| 10,649,399 | B1 | 5/2020 | Leemhuis et al. |
| 10,698,363 | B1 | 6/2020 | Carpenter et al. |
| 10,761,476 | B1 | 9/2020 | Leemhuis et al. |
| 10,775,737 | B1 | 9/2020 | Leemhuis et al. |
| 2009/0169256 | A1 | 7/2009 | Kamimura et al. |
| 2011/0158682 | A1 | 6/2011 | Takagi et al. |
| 2014/0363189 | A1 | 12/2014 | Hashimoto et al. |
| 2015/0098721 | A1 | 4/2015 | Buchanan et al. |
| 2020/0356044 | A1 | 11/2020 | Leemhuis et al. |
| 2020/0371469 | A1 | 11/2020 | Leemhuis et al. |

FOREIGN PATENT DOCUMENTS

| | | | |
|---|---|---|---|
| JP | H10239933 | A | 9/1998 |
| JP | 2006-196146 | A | 7/2005 |
| JP | 2006-119467 | A | 5/2006 |
| JP | 2013-137427 | A | 7/2013 |

OTHER PUBLICATIONS

U.S. Appl. No. 17/152,244, filed Jan. 19, 2021 (Blair et al.).
U.S. Appl. No. 17/152,264, filed Jan. 19, 2021 (Amann et al.).
U.S. Appl. No. 17/152,285, filed Jan. 19, 2021 (Chen et al.).
EPO machine translation of JP 2006-119467 A (Kusudo).
EPO machine translation of JP 2013-137427 A (Nishiyama).
EPO machine translation of JP H10239933 A (Furusawa).
EPO machine translation of JP 2006-196146 A (Abe et al.).
U.S. Appl. No. 17/236,447, filed Apr. 21, 2021 (Johnson et al.).
U.S. Appl. No. 17/236,468, filed Apr. 21, 2021 (Johnson et al.).
U.S. Appl. No. 17/236,502, filed Apr. 21, 2021 (Johnson et al.).

* cited by examiner

ELECTRICAL CONNECTOR ASSEMBLY FOR AN IMAGE FORMING DEVICE

CROSS REFERENCES TO RELATED APPLICATIONS

This application claims priority to U.S. Provisional Patent Application Ser. No. 63/014,797, filed Apr. 24, 2020, entitled "Electrical Connector for an Image Forming Device," the content of which is hereby incorporated by reference in its entirety.

BACKGROUND

1. Field of the Disclosure

The present disclosure relates generally to image forming devices and more particularly to an electrical connector assembly for an image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units that have a shorter lifespan than the image forming device. It is desired to communicate various operating parameters and usage information of the replaceable unit(s) to the image forming device for proper operation. For example, it may be desired to communicate such information as replaceable unit serial number, replaceable unit type, toner color, toner capacity, amount of toner remaining, license information, etc. The replaceable unit(s) typically include processing circuitry configured to communicate with and respond to commands from a controller in the image forming device. The replaceable unit(s) also include memory associated with the processing circuitry that stores program instructions and information related to the replaceable unit. The processing circuitry and associated memory are typically mounted on a circuit board that is attached to the replaceable unit. The replaceable unit also includes one or more electrical contacts that mate with corresponding electrical contacts in the image forming device upon installation of the replaceable unit in the image forming device in order to facilitate communication between the processing circuitry of the replaceable unit and the controller of the image forming device. It is important to accurately position the electrical contacts of the image forming device relative to the corresponding electrical contacts of the replaceable unit in order to ensure a reliable connection between the controller of the image forming device and the processing circuitry of the replaceable unit when the replaceable unit is installed in the image forming device. Accordingly, positioning features that provide precise alignment of the electrical contacts of the image forming device with corresponding electrical contacts of the replaceable unit are desired.

SUMMARY

An assembly for an electrophotographic image forming device according to one example embodiment includes an access door movable between an open position permitting user replacement of a replaceable unit of the image forming device and a closed position. An electrical connector mounted in the image forming device is movable relative to a frame of the image forming device between a retracted position and an extended position. In the retracted position the electrical connector is disengaged from a corresponding electrical connector of the replaceable unit when the replaceable unit is installed in the image forming device. In the extended position the electrical connector is engaged with the corresponding electrical connector of the replaceable unit when the replaceable unit is installed in the image forming device. The electrical connector is operatively connected to the access door of the image forming device such that movement of the access door from the closed position to the open position moves the electrical connector from the extended position to the retracted position and movement of the access door from the open position to the closed position moves the electrical connector from the retracted position to the extended position.

An assembly for an electrophotographic image forming device according to another example embodiment includes an access door movable between an open position permitting user replacement of a replaceable unit of the image forming device and a closed position. An electrical connector mounted in the image forming device is movable relative to a frame of the image forming device between a retracted position and an extended position. In the retracted position the electrical connector is disengaged from a corresponding electrical connector of the replaceable unit when the replaceable unit is installed in the image forming device. In the extended position the electrical connector is engaged with the corresponding electrical connector of the replaceable unit when the replaceable unit is installed in the image forming device. A camming member is rotatable between a first rotational position and a second rotational position. The camming member is operatively connected to the electrical connector and to the access door such that movement of the access door from the closed position to the open position rotates the camming member from the first rotational position to the second rotational position which moves the electrical connector from the extended position to the retracted position and movement of the access door from the open position to the closed position rotates the camming member from the second rotational position to the first rotational position which moves the electrical connector from the retracted position to the extended position.

An assembly for an electrophotographic image forming device according to another example embodiment includes an access door movable between an open position permitting user replacement of a first replaceable unit and a second replaceable unit of the image forming device and a closed position. An electrical connector mounted in the image forming device is movable relative to a frame of the image forming device between a retracted position and an extended position. In the retracted position the electrical connector is disengaged from a first corresponding electrical connector of the first replaceable unit and a second corresponding electrical connector of the second replaceable unit when the first and second replaceable units are installed in the image forming device. In the extended position the electrical connector is engaged with the first corresponding electrical connector of the first replaceable unit and the second corresponding electrical connector of the second replaceable unit when the first and second replaceable units are installed in the image forming device. The electrical connector is operatively connected to the access door of the image forming device such that movement of the access door from the closed position to the open position moves the electrical connector from the extended position to the retracted position and movement of the access door from the open position to the closed position moves the electrical connector from the retracted position to the extended position.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
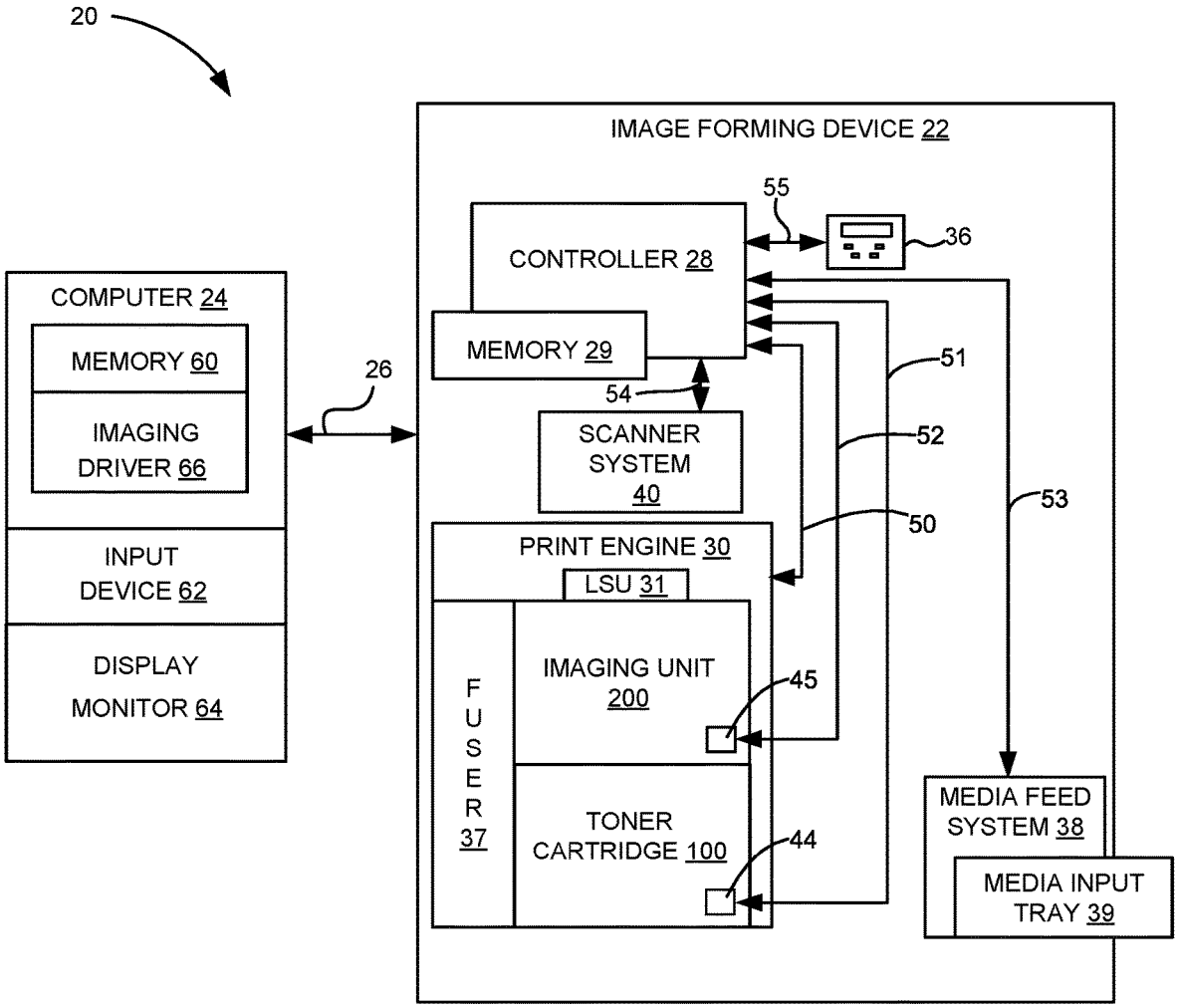
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, an imaging unit 200, a user interface 36, a media feed system 38, a media input tray 39 and a scanner system 40. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with imaging unit 200 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Controller 28 processes print and scan data and operates print engine 30 during printing and scanner system 40 during scanning. Processing circuitry 44, 45 may provide authentication functions, safety and operational interlocks, operating parameters and usage information related to toner cartridge 100 and imaging unit 200, respectively. Each of processing circuitry 44, 45 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44, 45.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 100, imaging unit 200 and a fuser 37, all mounted within image forming device 22. Toner cartridge 100 and imaging unit 200 are removably mounted in image forming device 22. In one embodiment, toner cartridge 100 includes a developer unit that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. In another embodiment, the toner development system utilizes what is commonly referred to as a dual component development system. In this embodiment, toner in the toner reservoir of the developer unit is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, the developer unit includes a developer roll that attracts the magnetic carrier beads having toner thereon to the developer roll through the use of magnetic fields. In one embodiment, imaging unit 200 includes a photoconductor unit that houses a charge roll, a photoconductive drum and a waste toner removal system. Although the example image forming device 22 illustrated in FIG. 1 includes one toner cartridge and imaging unit, in the case of an image forming device configured to print in color, separate toner cartridges and imaging units may be used for each toner color. For example, in one embodiment, the image forming device includes four toner cartridges, each containing a particular toner color (e.g., black, cyan, yellow and magenta) to permit color printing, and four corresponding imaging units.

The electrophotographic printing process is well known in the art and, therefore, is described briefly herein. During a printing operation, laser scan unit 31 creates a latent image on the photoconductive drum in imaging unit 200. Toner is transferred from the toner reservoir in toner cartridge 100 to the latent image on the photoconductive drum by the developer roll to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
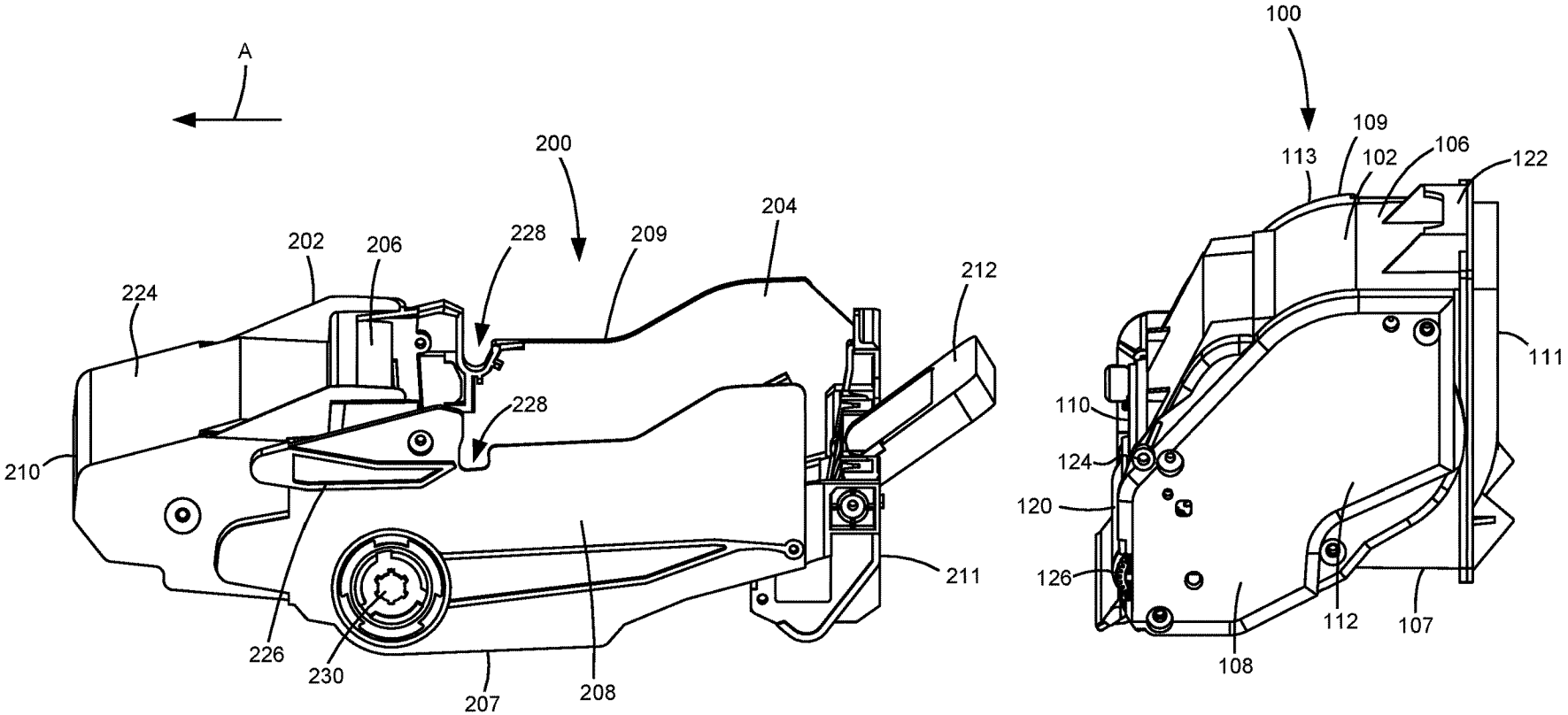
FIG. 2 is a perspective view of a toner cartridge and an imaging unit according to one example embodiment.

Referring now to FIG. 2, toner cartridge 100 and imaging unit 200 are shown according to one example embodiment. As discussed above, toner cartridge 100 and imaging unit 200 are each removably installed in image forming device 22. Toner cartridge 100 is first installed on a frame 204 of imaging unit 200 and mated with imaging unit 200. Toner cartridge 100 and imaging unit 200 are then slidably inserted together into image forming device 22. The arrow A shown in FIG. 2 indicates the direction of insertion of toner cartridge 100 and imaging unit 200 into image forming device 22. This arrangement allows toner cartridge 100 and imaging unit 200 to be easily removed from and reinstalled in image forming device 22 as a single unit, while permitting toner cartridge 100 and imaging unit 200 to be repaired or replaced separately from each other.

Figure 3:
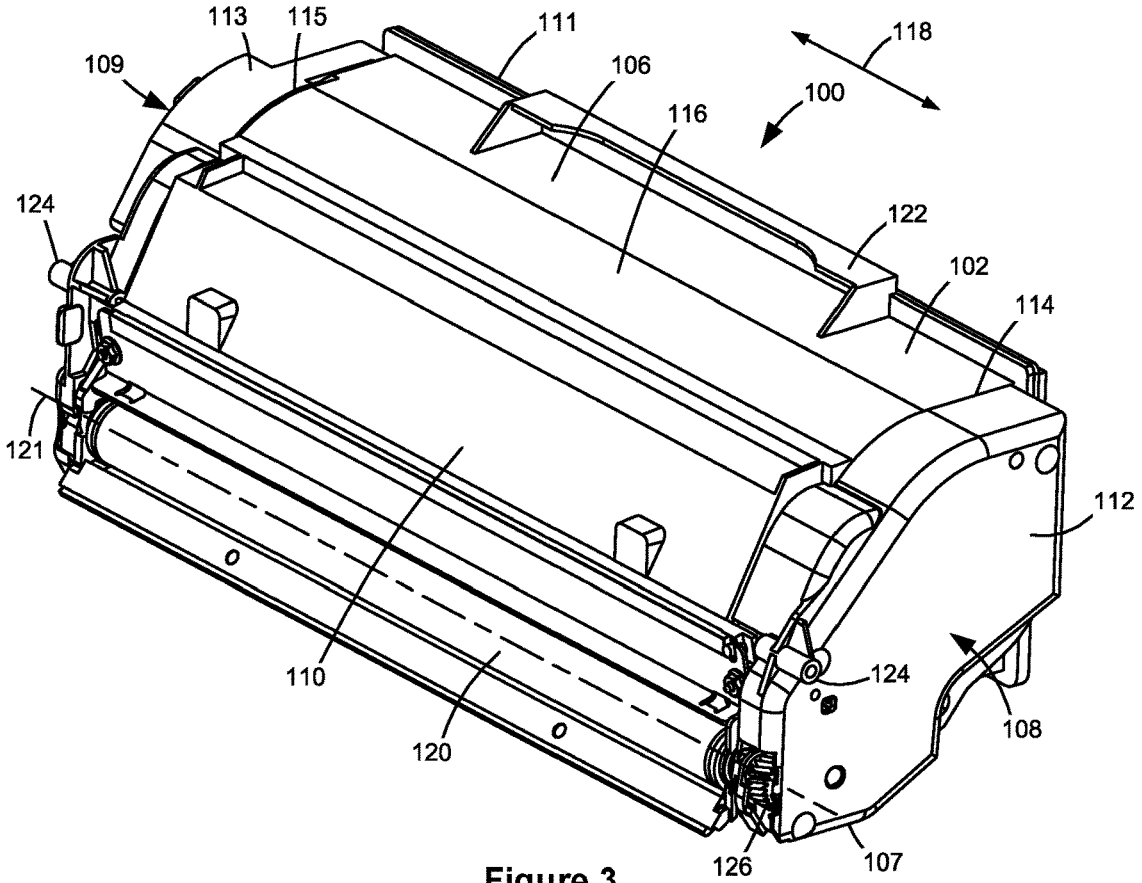
FIG. 3 is a front perspective view of the toner cartridge shown in FIG. 2.
Figure 4:
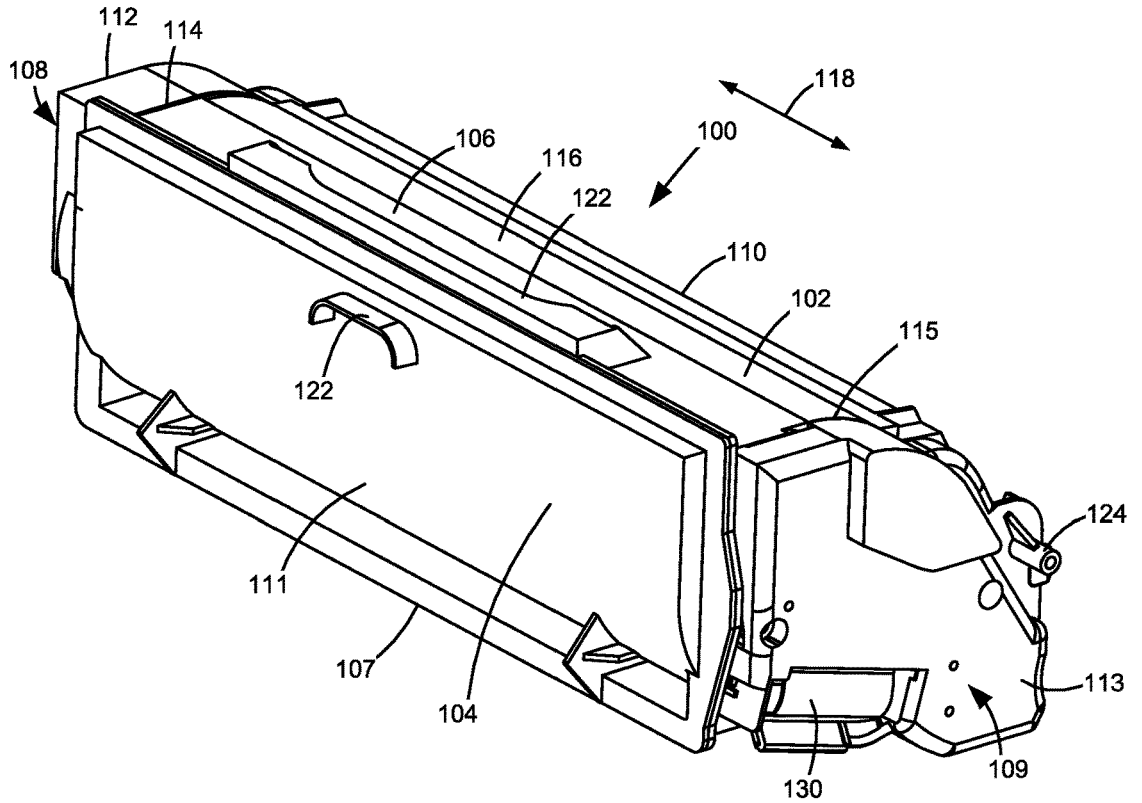
FIG. 4 is a rear perspective view of the toner cartridge shown in FIGS. 2 and 3.

With reference to FIGS. 2-4, toner cartridge 100 includes a housing 102 having an enclosed reservoir 104 for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. In one embodiment, each side 108, 109 of housing 102 includes an end cap 112, 113 mounted, e.g., by fasteners or a snap-fit engagement, to side walls 114, 115 of a main body 116 of housing 102. In the example embodiment illustrated, toner cartridge 100 includes a rotatable developer roll 120 having a rotational axis 121 that runs along a side-to-side dimension 118 of housing 102, from side 108 to side 109. A portion of developer roll 120 is exposed from housing 102 along front 110 of housing 102, near bottom 107 of housing 102 for delivering toner from toner cartridge 100 to a corresponding photoconductive drum of imaging unit 200. In this manner, developer roll 120 forms an outlet for exiting toner from toner cartridge 100. A handle 122 may be provided on top 106 or rear 111 of housing 102 to assist with coupling and decoupling toner cartridge 100 to and from imaging unit 200 and insertion and removal of toner cartridge 100 and imaging unit 200 into and out of image forming device 22.

Sides 108, 109 may each include one or more alignment guides 124 that extend outward from the respective side 108, 109 to assist with mating toner cartridge 100 to imaging unit 200. Alignment guides 124 are received by corresponding guide rails on imaging unit 200 that aid in positioning toner cartridge 100 relative to imaging unit 200. In the example embodiment illustrated, an alignment guide 124 is positioned on an outer side of each end cap 112, 113.

Toner cartridge 100 also includes a drive gear 126 positioned on side 108 of housing 102. In the embodiment illustrated, drive gear 126 mates with and receives rotational force from a corresponding drive gear on imaging unit 200 in order to provide rotational force to developer roll 120 and other rotatable components of toner cartridge 100 for moving toner to developer roll 120 when toner cartridge 100 is installed in image forming device 22. In the embodiment illustrated, drive gear 126 is mounted to a shaft of developer roll 120, coaxial with developer roll 120. In this embodiment, a front portion of drive gear 126 is exposed on the front 110 of housing 102, near bottom 107 of housing 102 and is unobstructed to mate with and receive rotational force from the corresponding drive gear on imaging unit 200. In the embodiment illustrated, drive gear 126 is rotatably connected to a drive train that is positioned between end cap 112 and side wall 114 of housing 102. The drive train aids in transferring rotational force from drive gear 126 to rotatable components of toner cartridge 100, including, for example, to a toner adder roll that provides toner from reservoir 104 to developer roll 120 and to one or more toner agitators that move toner in reservoir 104 toward the toner adder roll and that agitate and mix the toner in reservoir 104. In the example embodiment illustrated, drive gear 126 is formed as a helical gear, but other configurations may be used as desired.

Toner cartridge 100 also includes an electrical connector 130 positioned on side 109 of housing 102 that includes one or more electrical contacts 132 (FIG. 8) that mate with corresponding electrical contacts in image forming device 22 when toner cartridge 100 is installed in image forming device 22 in order to facilitate communications link 51 between controller 28 of image forming device 22 and processing circuitry 44 of toner cartridge 100 as discussed in greater detail below.

Figure 5:
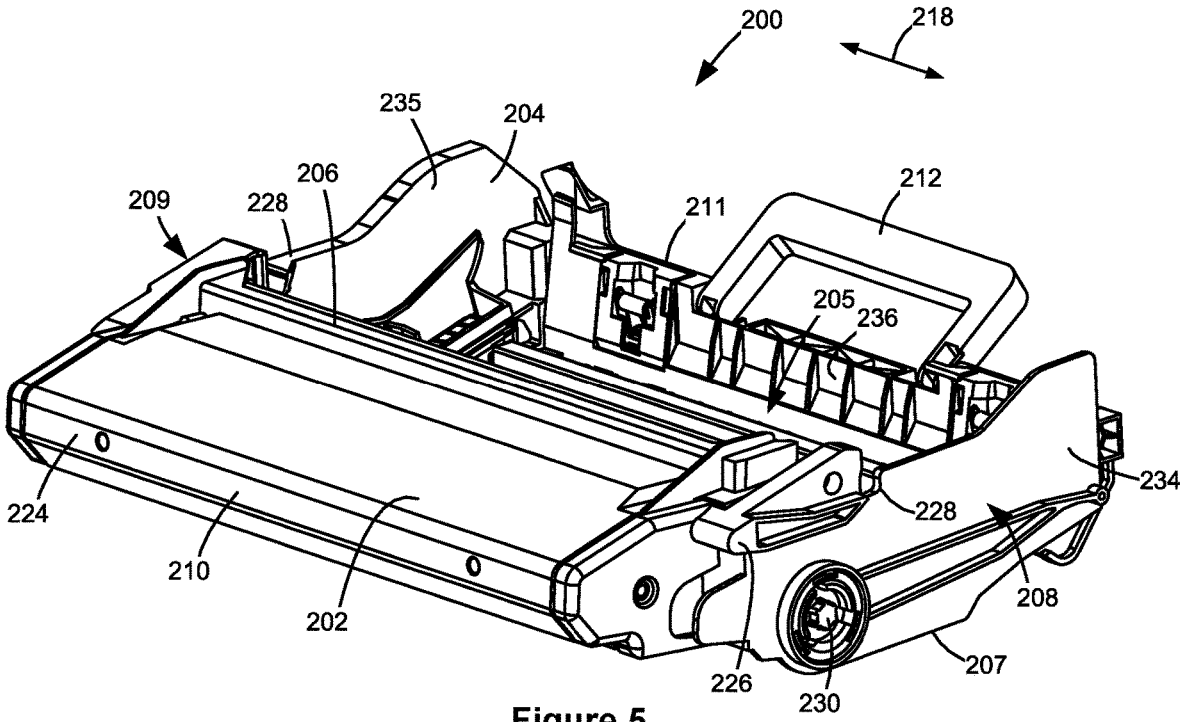
FIG. 5 is a front perspective view of the imaging unit shown in FIG. 2.
Figure 6:
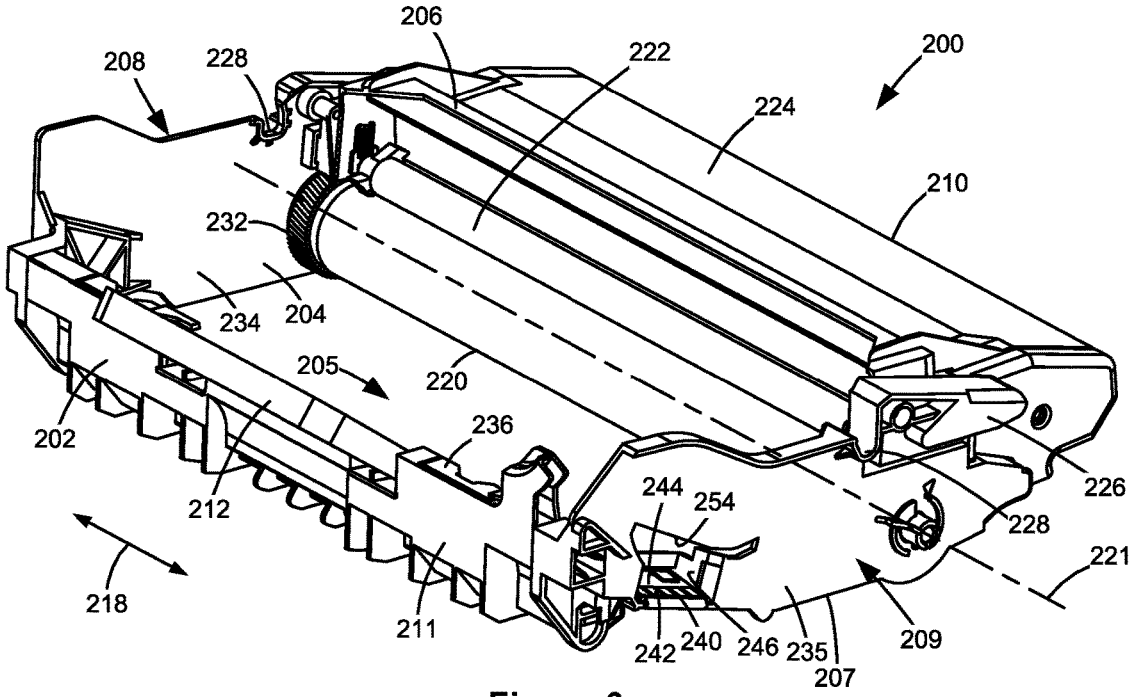
FIG. 6 is a rear perspective view of the imaging unit shown in FIGS. 2 and 5.

With reference to FIGS. 2, 5 and 6, imaging unit 200 includes a housing 202 including a top 206, a bottom 207, first and second sides 208, 209, a front 210 and a rear 211. Front 210 of housing 202 leads during insertion of imaging unit 200 into image forming device 22 and rear 211 trails. In the embodiment illustrated, frame 204 includes a toner cartridge receiving area 205 positioned at rear 211 of housing 202. A handle 212 may be provided on rear 211 of housing 202, e.g., on frame 204, to assist with insertion and removal of toner cartridge 100 and imaging unit 200 into and out of image forming device 22.

In the example embodiment illustrated, imaging unit 200 includes a rotatable photoconductive drum 220 having a rotational axis 221 that runs along a side-to-side dimension 218 of housing 202, from side 208 to side 209. A rear portion of photoconductive drum 220 is open to toner cartridge receiving area 205 of frame 204 for receiving toner from developer roll 120 of toner cartridge 100. A bottom portion of photoconductive drum 220 is exposed from housing 202 on bottom 207 of housing 202. Toner on the outer surface of photoconductive drum 220 is transferred from the bottom portion of the outer surface of photoconductive drum 220 to a media sheet or intermediate transfer member during a print operation. Imaging unit 200 also includes a rotatable charge roll 222 in contact with the outer surface of photoconductive drum 220 that charges the outer surface of photoconductive drum 220 to a predetermined voltage. Imaging unit 200 also includes a waste toner removal system that may include a cleaner blade or roll that removes residual toner from the outer surface of photoconductive drum 220. In the example embodiment illustrated, imaging unit 200 includes a waste toner reservoir 224 positioned at the front 210 of housing 202. Waste toner reservoir 224 stores toner removed from photoconductive drum 220 by the cleaner blade or roll.

Sides 208, 209 may each include one or more alignment guides 226 that extend outward from the respective side 208, 209 to assist with insertion and removal of toner cartridge 100 and imaging unit 200 into and out of image forming device 22. Alignment guides 226 are received by corresponding guide rails in image forming device 22 that aid in positioning toner cartridge 100 and imaging unit 200 relative to image forming device 22. Sides 208, 209 of frame 204 may each include a guide rail 228 that receives a corresponding alignment guide 124 of toner cartridge 100 to aid in positioning toner cartridge 100 relative to imaging unit 200.

Imaging unit 200 also includes a drive coupler 230 positioned on side 208 of housing 202. Drive coupler 230 mates with and receives rotational force from a corresponding drive coupler in image forming device 22 in order to provide rotational force to photoconductive drum 220 when imaging unit 200 is installed in image forming device 22. In the embodiment illustrated, drive coupler 230 is positioned at an axial end of photoconductive drum 220, coaxial with photoconductive drum 220. In this embodiment, an outer axial end of drive coupler 230 is exposed on side 208 of housing 202 and is unobstructed to mate with and receive rotational force from the corresponding drive coupler in image forming device 22. In the example embodiment illustrated, drive coupler 230 is configured to receive rotational force at the outer axial end of drive coupler 230, but other configurations may be used as desired. In some embodiments, charge roll 222 is driven by friction contact between the surfaces of charge roll 222 and photoconductive drum 220. In other embodiments, charge roll 222 is connected to drive coupler 230 by one or more gears.

In the embodiment illustrated, imaging unit 200 also includes a drive gear 232 attached to photoconductive drum 220, axially inboard of drive coupler 230. A portion of drive gear 232 is exposed to toner cartridge receiving area 205 of frame 204 permitting drive gear 126 of toner cartridge 100 to mate with drive gear 232 of imaging unit 200 when toner cartridge 100 is installed on frame 204 of imaging unit 200 to permit the transfer of rotational force received by drive coupler 230 of imaging unit 200 to drive gear 126 of toner cartridge 100 by way of drive gear 232 of imaging unit 200.

Imaging unit 200 also includes an electrical connector 240 positioned on a portion of frame 204 on side 209 of housing 202 that includes one or more electrical contacts 242 that mate with corresponding electrical contacts in image forming device 22 when imaging unit 200 is installed in image forming device 22 in order to facilitate communications link 52 between controller 28 of image forming device 22 and processing circuitry 45 of imaging unit 200 as discussed in greater detail below.

Figure 7:
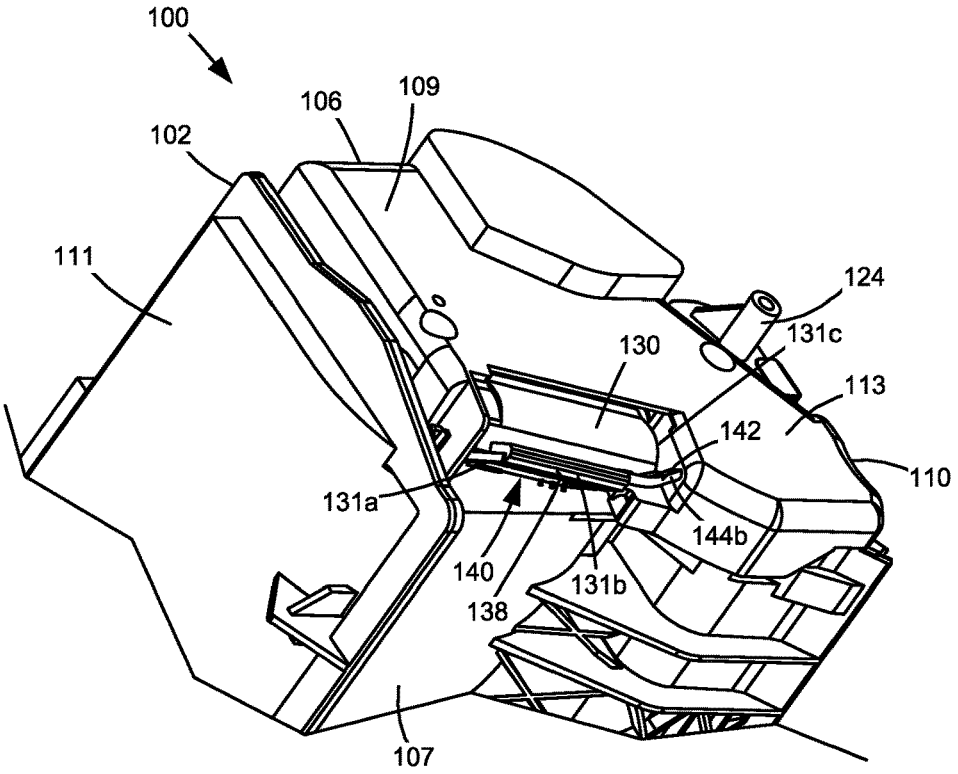
FIG. 7 is a perspective view showing an electrical connector of the toner cartridge in a retracted position according to one example embodiment.
Figure 8:
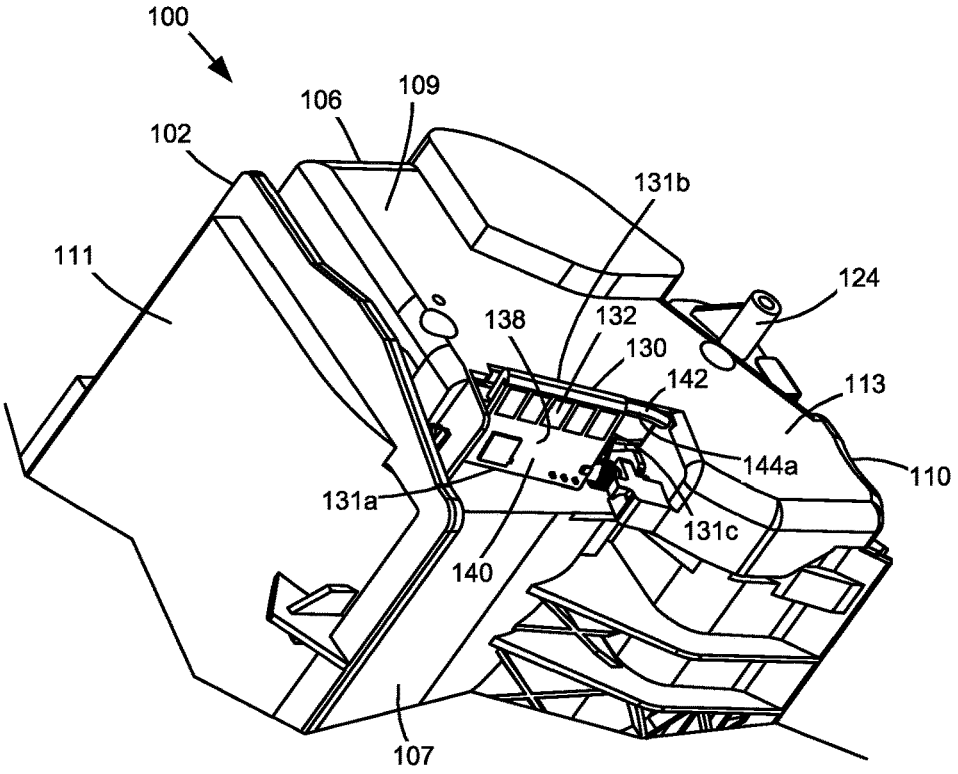
FIG. 8 is a perspective view showing the electrical connector of the toner cartridge in an operative position according to one example embodiment.
Figure 9:
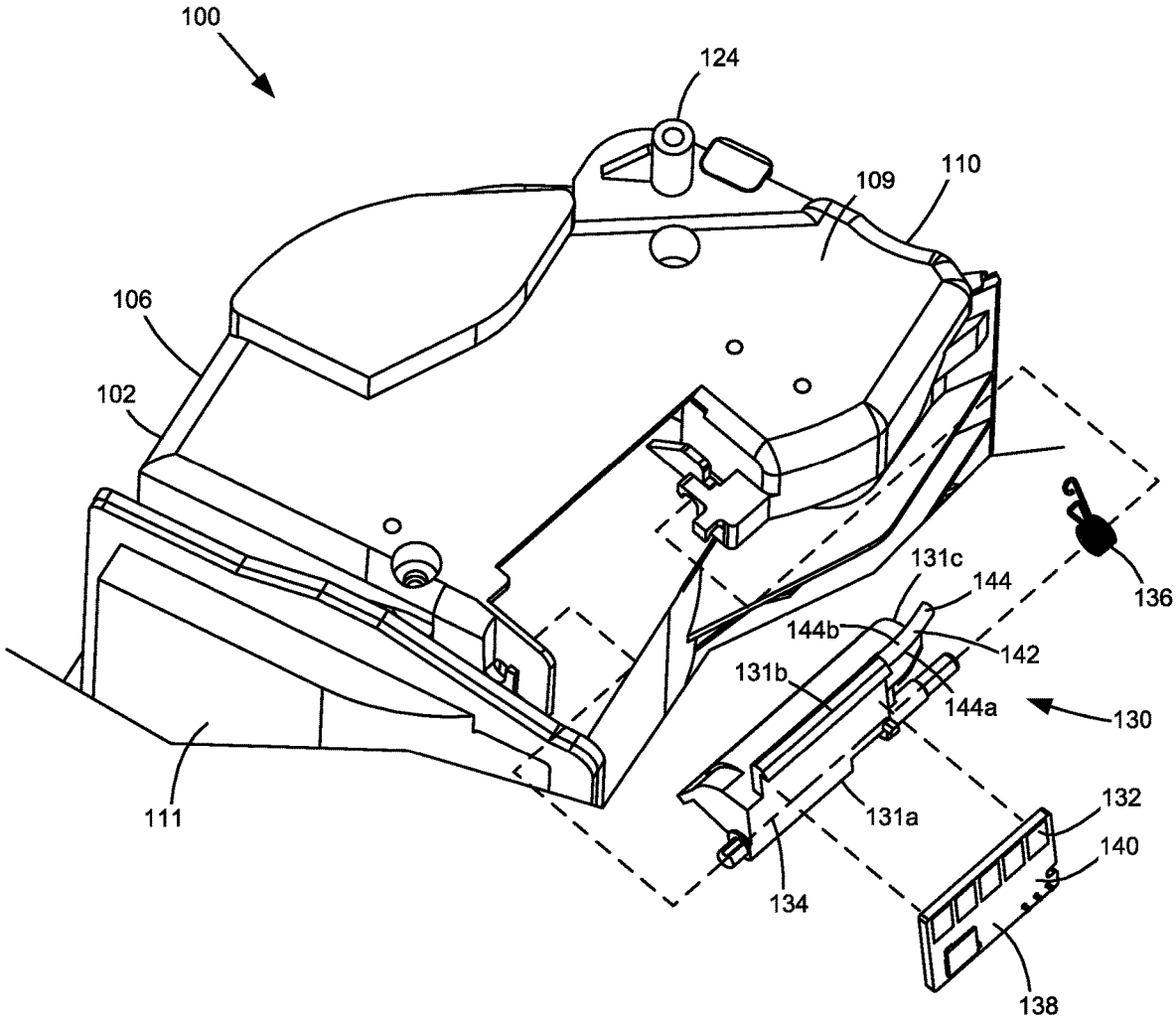
FIG. 9 is an exploded view of the electrical connector of the toner cartridge according to one example embodiment.

FIGS. 7-9 show electrical connector 130 of toner cartridge 100 in greater detail. In the example embodiment illustrated, electrical connector 130 is positioned on side 109 of housing, near bottom 107 and rear 111 of housing 102. Electrical connector 130 is movably connected to housing 102 such that electrical connector 130 is movable relative to housing 102 between a retracted or home position shown in FIG. 7 and an operative position shown in FIG. 8. In the example embodiment illustrated, electrical connector 130 is pivotable about a pivot axis 134 relative to housing 102 between the retracted position and the operative position. In the example embodiment illustrated, pivot axis 134 extends in a direction from rear 111 to front 110 and angles downward from rear 111 to front 110, but pivot axis 134 may take other orientations as desired. In the example embodiment illustrated, pivot axis 134 is positioned along a proximal end 131*a* of electrical connector 130 relative to side 109 of housing 102 and reservoir 104 along side-to-side dimension 118 of housing 102. In some embodiments, electrical connector 130 is biased toward the retracted position by a biasing member 136. In the example embodiment illustrated, biasing member 136 includes a torsion spring; however, any suitable biasing member 136 may be used as desired, such as, for example, one or more compression springs, extension springs, leaf springs or a material having resilient properties.

In the embodiment illustrated, electrical connector 130 includes a printed circuit board 138 having electrical contacts 132 and processing circuitry 44 positioned thereon. Printed circuit board 138 may be attached by a suitable fastener or adhesive as desired. Electrical contacts 132 are positioned on a face 140 of printed circuit board 138. In the example embodiment illustrated, in the retracted position of electrical connector 130 shown in FIG. 7, face 140 of printed circuit board 138 including electrical contacts 132 faces downward, toward bottom 107 of housing 102, and inward, toward side 109 of housing 102. In addition to facing downward and inward, in the embodiment illustrated, face 140 of printed circuit board 138 including electrical contacts 132 also faces rearward, toward rear 111 of housing 102, when electrical connector is in its retracted position due to the angle of pivot axis 134. In the operative position of electrical connector 130 shown in FIG. 8, face 140 of printed circuit board 138 including electrical contacts 132 faces downward, toward bottom 107 of housing 102, such as, for example, primarily downward. In addition to facing downward, in the embodiment illustrated, face 140 of printed circuit board 138 including electrical contacts 132 also faces rearward, toward rear 111 of housing 102, due to the angle of pivot axis 134 and slightly outward, away from side 109 of housing 102, when electrical connector is in its operative position. Electrical contacts 132 are positioned along a distal end 131*b* of electrical connector 130 relative to side 109 of housing 102 and reservoir 104 along side-to-side dimension 118 of housing 102, which also forms a free end of electrical connector 130 relative to pivot axis 134 in the embodiment illustrated, when electrical connector 130 is in its operative position.

Accordingly, in this embodiment, when electrical connector 130 moves from its retracted position to its operative position, electrical connector 130 pivots upward relative to housing 102 about pivot axis 134 with face 140 of printed circuit board 138 including electrical contacts 132 swinging upward and outward, away from side 109, about pivot axis 134. This movement is reversed when electrical connector 130 moves from its operative position to its retracted position wherein electrical connector 130 pivots downward relative to housing 102 about pivot axis 134 with face 140 of printed circuit board 138 including electrical contacts 132 swinging downward and inward, toward side 109, about pivot axis 134. In the example embodiment illustrated, when electrical connector 130 is in its operative position with face 140 of printed circuit board 138 facing downward, electrical contacts 132 are exposed from housing 102 and unobstructed from below permitting corresponding electrical contacts in image forming device 22 to contact and mate with electrical contacts 132 of electrical connector 130 from below. In this embodiment, when electrical connector 130 is in its retracted position with printed circuit board 138 swung downward and inward, toward side 109, electrical contacts 132 are partially hidden from view in order to help protect electrical contacts 132 and printed circuit board 138 from contamination, electrostatic discharge and physical damage.

Electrical connector 130 includes an actuation member 142 that is positioned to receive a force to overcome the bias applied to electrical connector 130 by biasing member 136 in order to move electrical connector 130 from its retracted position to its operative position. In the embodiment illustrated, actuation member 142 includes a cam surface 144 along distal end 131*b* of electrical connector 130 that extends forward, toward front 110 of housing 102, from a front end 131*c* of electrical connector 130 that is proximate to front 110 of housing 102. Cam surface 144 includes a bottom portion 144*a* that faces downward, toward bottom 107 of housing 102, when electrical connector 130 is in its operative position and an outer side portion 144*b* that faces outward, away from side 109 of housing 102, when electrical connector 130 is in its operative position. In the embodiment illustrated, bottom portion 144*a* of cam surface 144 angles upward relative to face 140 of printed circuit board 138, away from face 140 of printed circuit board 138 and electrical contacts 132, in a direction from rear 111 to front 110 of housing 102 and outer side portion 144*b* of cam surface 144 angles inward, toward pivot axis 134, in a direction from rear 111 to front 110 of housing 102.

While the example embodiment illustrated includes electrical contacts 132 positioned on printed circuit board 138 having processing circuitry 44, in other embodiments, printed circuit board 138 having processing circuitry 44 is positioned elsewhere on housing 102 and electrical contacts 132 are disposed on electrical connector 130 in the positions illustrated and are connected to processing circuitry 44 by suitable traces, wires or the like.

Figure 10:
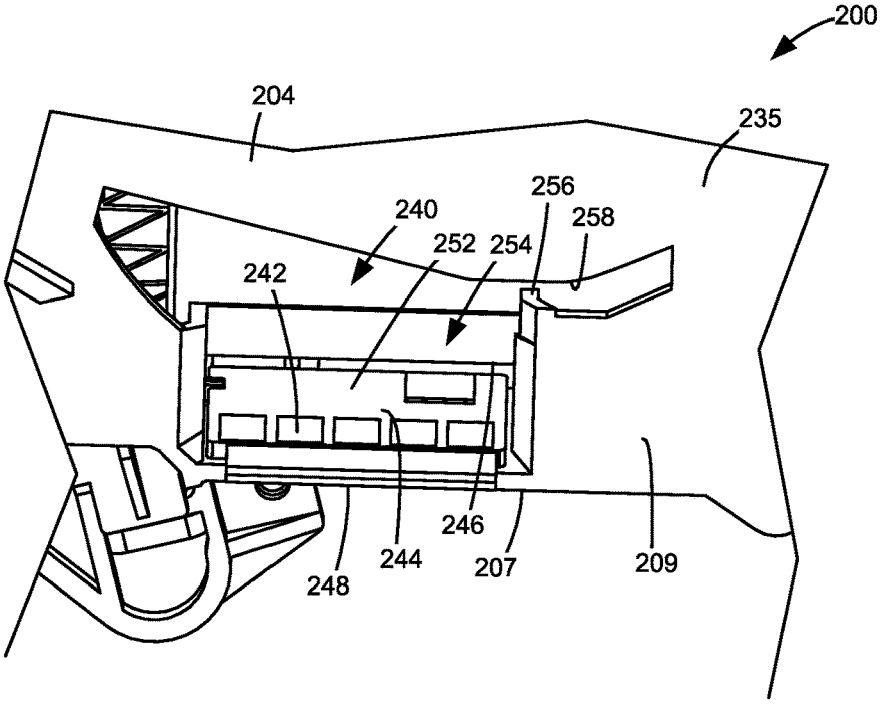
FIG. 10 is a side perspective view showing an electrical connector of the imaging unit according to one example embodiment.
Figure 11:
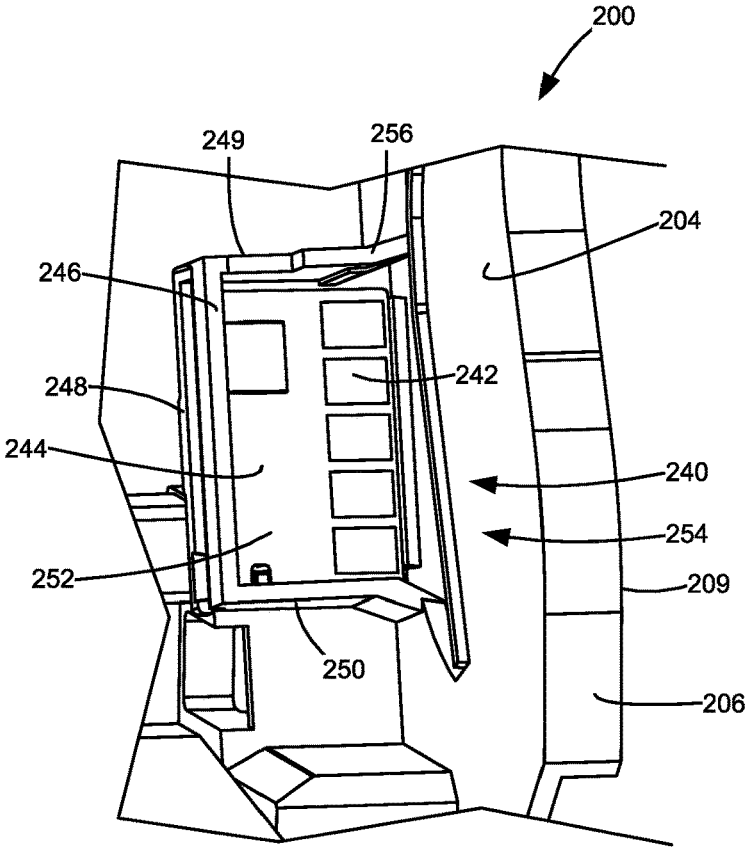
FIG. 11 is a top perspective view showing the electrical connector of the imaging unit according to one example embodiment.

FIGS. 10 and 11 show electrical connector 240 of imaging unit 200 in greater detail. In this embodiment, frame 204 of imaging unit 200 includes a side wall 234 on side 208 of housing 202, a side wall 235 on side 209 of housing 202 and a rear wall 236 on rear 211 of housing 202 (FIGS. 5 and 6). In this embodiment, electrical connector 240 includes a printed circuit board 244 positioned on a mount 246 on side wall 235 of frame 204. Printed circuit board 244 may be attached by a suitable fastener or adhesive as desired. Processing circuitry 45 of imaging unit 200 is positioned on printed circuit board 244. Mount 246 includes a bottom surface 248 and a front wall 249 and a rear wall 250 that extend upward from bottom surface 248 and along side-to-side dimension 218. In the embodiment illustrated, printed circuit board 244 is positioned on bottom surface 248 of mount 246 between front wall 249 and rear wall 250 of mount 246. In this embodiment, electrical contacts 242 are positioned on a top face 252 of printed circuit board 244 such that electrical contacts 242 face upward, toward top 206 of housing 202. Printed circuit board 244 and mount 246 are positioned adjacent to an opening 254 that extends through side wall 235 of frame 204 at an outer side of mount 246 and that permits corresponding electrical contacts in image forming device 22 to access and mate with electrical contacts 242 of electrical connector 240 of imaging unit 200 and electrical contacts 132 of electrical connector 130 of toner cartridge 100 from side 209 of housing 202 of imaging unit 200 and side 109 of housing 102 of toner cartridge 100 as discussed in greater detail below.

In the embodiment illustrated, front wall 249 of mount 246 includes an actuation member such as a cam surface 256 on a top edge of front wall 249 that contacts cam surface 144 of electrical connector 130 of toner cartridge 100 when toner cartridge 100 is installed on frame 204 of imaging unit 200 in order to move electrical connector 130 of toner cartridge 100 from its retracted position to its operative position as discussed in greater detail below. In this embodiment, cam surface 256 angles upward in a direction from side 208 to side 209 of housing 202. In the embodiment illustrated, an upstop 258 is spaced above cam surface 256 along a top edge of opening 254. Upstop 258 is positioned to limit the travel of electrical connector 130 of toner cartridge 100 from its retracted position to its operative position as discussed in greater detail below.

While the example embodiment illustrated includes electrical contacts 242 positioned on printed circuit board 244 having processing circuitry 45, in other embodiments, printed circuit board 244 having processing circuitry 45 is positioned elsewhere on housing 202 and electrical contacts 242 are disposed on electrical connector 240, e.g., on mount 246, in the positions illustrated and are connected to processing circuitry 45 by suitable traces, wires or the like.

Figure 12A:
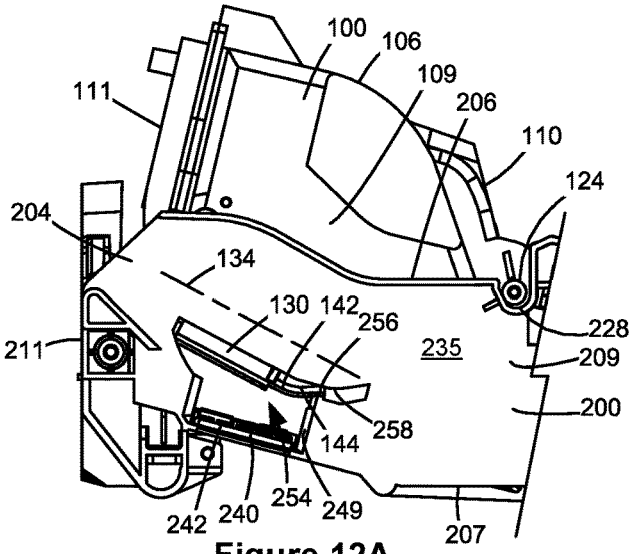
FIGS. 12A-12C are sequential side elevation views showing the actuation of the electrical connector of the toner cartridge from its retracted position to its operative position during installation of the toner cartridge onto the imaging unit according to one example embodiment.
Figure 12B:
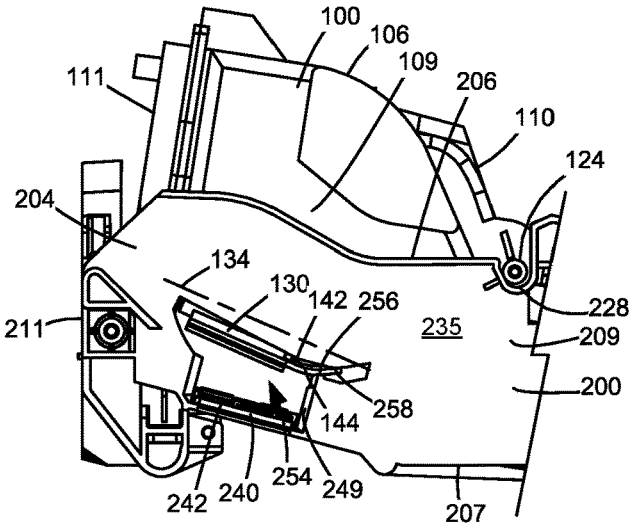
Figure 12C:
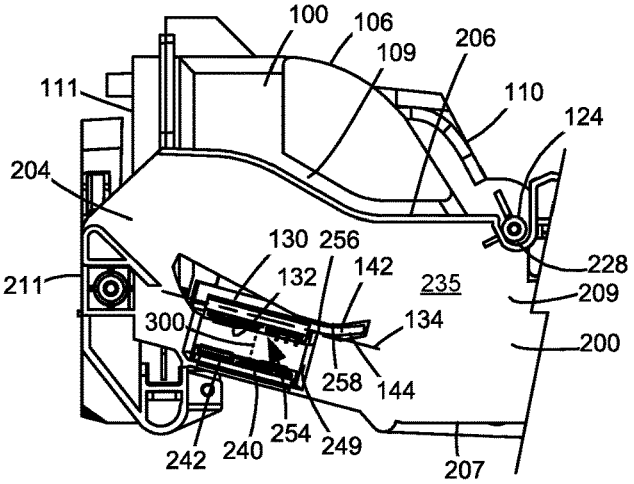

FIGS. 12A-12C are sequential views that show the actuation of electrical connector 130 of toner cartridge 100 from its retracted position to its operative position during the installation of toner cartridge 100 onto frame 204 of imaging unit 200. In the example embodiment illustrated, engagement between alignment guides 124 of toner cartridge 100 and guide rails 228 of imaging unit 200 controls the positioning of toner cartridge 100 relative to imaging unit 200 during installation of toner cartridge 100 onto frame 204 of imaging unit 200. In this embodiment, toner cartridge 100 pivots counterclockwise as viewed in FIGS. 12A-12C about a pivot axis that runs from alignment guide 124 on side 108 of housing 102 to alignment guide 124 on side 109 of housing 102 during installation of toner cartridge 100 onto frame 204 of imaging unit 200.

FIG. 12A shows toner cartridge 100 as it lowers into frame 204 of imaging unit 200 with electrical connector 130 of toner cartridge 100 in its retracted position as cam surface 144 of actuation member 142 of electrical connector 130 begins to contact cam surface 256 on front wall 249 of mount 246 of imaging unit 200. The contact between cam surface 144 of electrical connector 130 and cam surface 256 of imaging unit 200 as toner cartridge 100 lowers into frame 204 of imaging unit 200 overcomes the bias force applied to electrical connector 130 by biasing member 136 and causes electrical connector 130 to swing (out of the page as viewed in FIGS. 12A-12C) about pivot axis 134 from its retracted position toward its operative position. As toner cartridge 100 continues to lower into frame 204 of imaging unit 200, cam surface 144 of electrical connector 130 travels up the angled portion of cam surface 256 of imaging unit 200 causing electrical connector 130 to continue to pivot about pivot axis 134 from its retracted position toward its operative position. FIG. 12B shows electrical connector 130 of toner cartridge 100 in an intermediate position between the retracted position and the operative position as toner cartridge 100 lowers into frame 204 of imaging unit 200. When toner cartridge 100 reaches its final, installed position relative to imaging unit 200, contact between cam surface 144 of electrical connector 130 and cam surface 256 of imaging unit 200 holds electrical connector 130 of toner cartridge 100 in its operative position with electrical contacts 132 of electrical connector 130 facing downward.

FIG. 12C shows toner cartridge 100 fully installed on frame 204 of imaging unit 200 with electrical connector 130 in its operative position. When toner cartridge 100 is in its final position relative to imaging unit 200, electrical contacts 132 of toner cartridge 100 and electrical contacts 242 of imaging unit 200 are exposed to an exterior of imaging unit 200 through opening 254 in side wall 235 of frame 204 permitting an electrical connector in image forming device 22 to enter opening 254 and mate with electrical contacts 132 of toner cartridge 100 and electrical contacts 242 of imaging unit 200 when toner cartridge 100 and imaging unit 200 are installed in image forming device 22. In this embodiment, when toner cartridge 100 is in its final position relative to imaging unit 200 with electrical connector 130 of toner cartridge 100 in its operative position, electrical contacts 132 of toner cartridge 100 face downward and electrical contacts 242 of imaging unit 200 face upward such that electrical contacts 132 of toner cartridge 100 and electrical contacts 242 of imaging unit 200 face each other in a spaced relationship with a vertical gap 290 (FIG. 22B) positioned between electrical contacts 132 of toner cartridge 100 and electrical contacts 242 of imaging unit 200.

Figure 13:
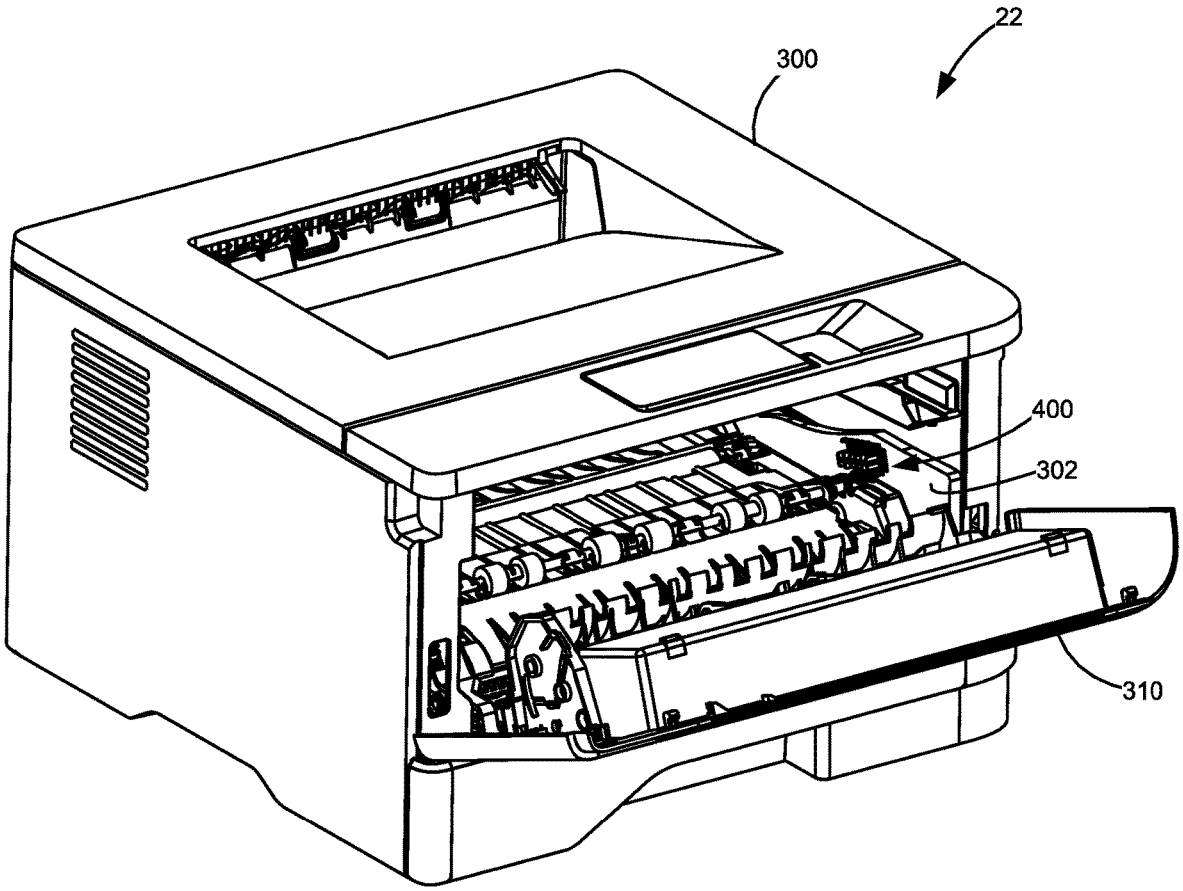
FIG. 13 is a perspective view of the image forming device having an electrical connector assembly according to one example embodiment.

FIG. 13 illustrates an example embodiment of image forming device 22 having a housing 300 and an access door 310 positioned on housing 300. Access door 310 permits user access to toner cartridge 100 and imaging unit 200 within image forming device 22. In the embodiment illustrated, access door 310 is in an open position with toner cartridge 100 and imaging unit 200 removed from image forming device 22 to expose an electrical connector assembly 400 on a side 302 of image forming device 22. Electrical connector assembly 400 is positioned to engage electrical connector 130 of toner cartridge 100 and electrical connector 240 of imaging unit 200 when toner cartridge 100 and imaging unit 200 are installed in image forming device 22.

Figure 14:
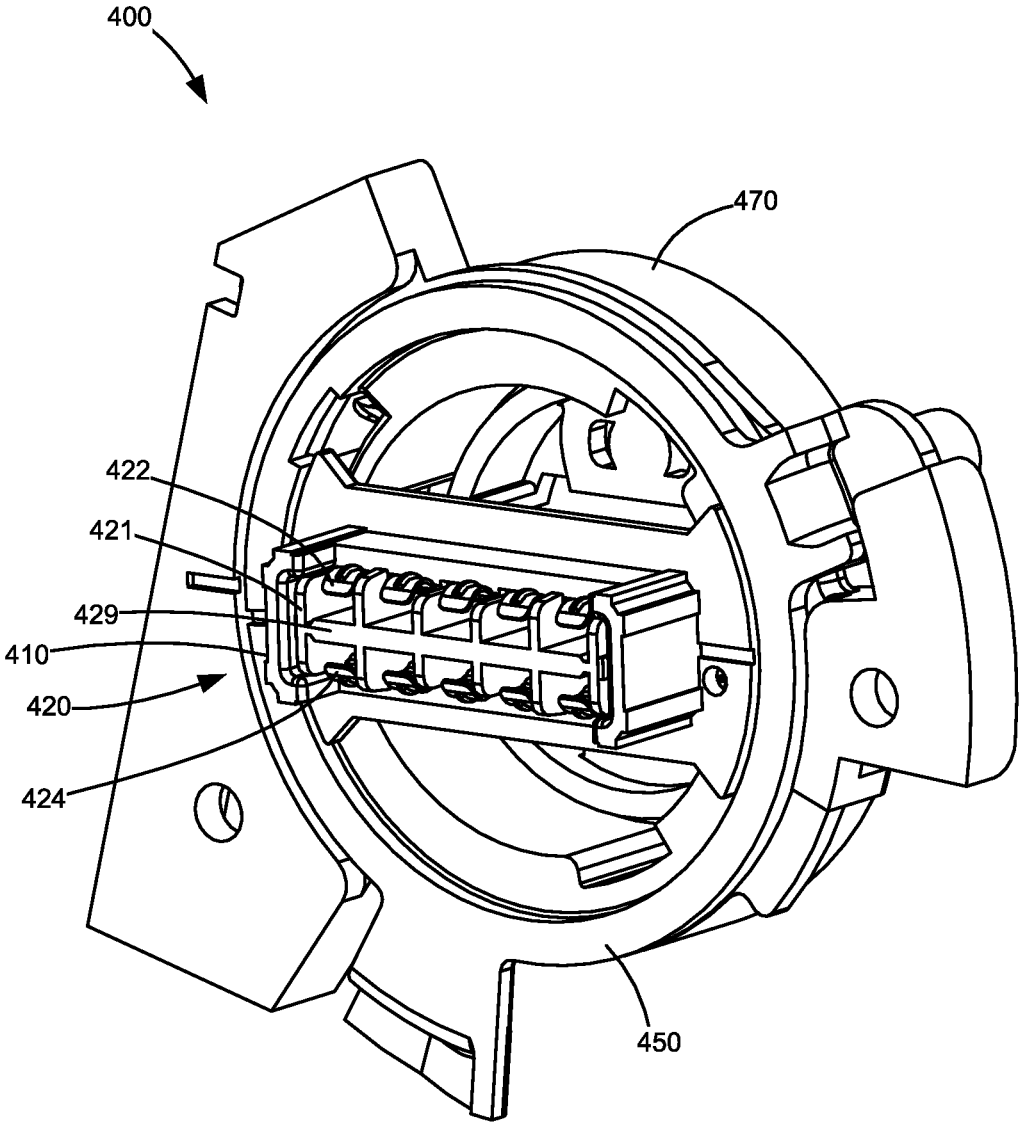
FIG. 14 is an inner side perspective view of the electrical connector assembly in a retracted position according to one example embodiment.
Figure 15:
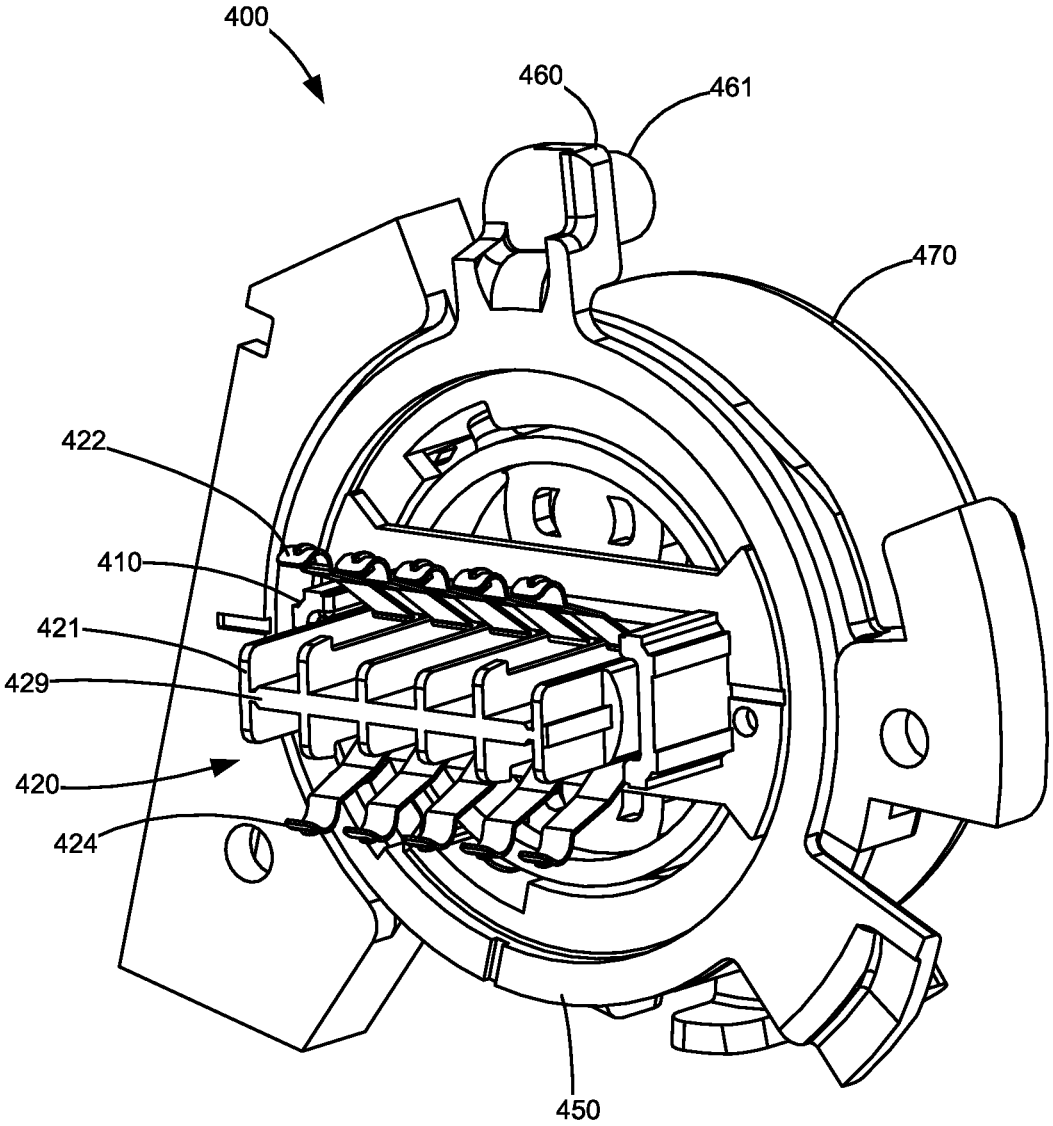
FIG. 15 is an inner side perspective view of the electrical connector assembly in an extended position according to one example embodiment.

FIGS. 14-17 illustrate electrical connector assembly 400 of image forming device 22 in greater detail. In the embodiment illustrated, electrical connector assembly 400 includes a floating track 410 that extends inward into an interior portion of image forming device 22 from side 302 of image forming device 22 and a contacts submodule 420 movable within floating track 410. In the embodiment illustrated, contacts submodule 420 of electrical connector assembly 400 is movable relative to floating track 410 between a retracted position shown in FIG. 14 and an extended position shown in FIG. 15. Contacts submodule 420 includes upper electrical contacts 422 on an upper portion thereof and lower electrical contacts 424 on a lower portion thereof. In the retracted position, upper and lower electrical contacts 422, 424 of contacts submodule 420 are deflected inwardly and contracted, nested within floating track 410 as shown in FIG. 14. In the extended position, upper and lower electrical contacts 422, 424 of contacts submodule 420 expand outwardly from floating track 410 as shown in FIG. 15.

Upper electrical contacts 422 of contacts submodule 420 are positioned to contact electrical contacts 132 of toner cartridge 100 to facilitate communications link 51 between controller 28 of image forming device 22 and processing circuitry 44 of toner cartridge 100 when contacts submodule 420 of electrical connector assembly 400 moves from the retracted position to the extended position after toner cartridge 100 and imaging unit 200 are installed in image forming device 22. Similarly, lower electrical contacts 424 of contacts submodule 420 are positioned to contact electrical contacts 242 of imaging unit 200 to facilitate communications link 52 between controller 28 of image forming device 22 and processing circuitry 45 of imaging unit 200 when contacts submodule 420 of electrical connector assembly 400 moves from the retracted position to the extended position after toner cartridge 100 and imaging unit 200 are installed in image forming device 22. Accordingly, when contacts submodule 420 is in the retracted position while toner cartridge 100 and imaging unit 200 are installed in image forming device 22, electrical connector assembly 400 is in a disengaged position relative to electrical contacts 132 of toner cartridge 100 and electrical contacts 242 of imaging unit 200. When contacts submodule 420 is in the extended position while toner cartridge 100 and imaging unit 200 are installed in image forming device 22, electrical connector assembly 400 is in an engaged position relative to electrical contacts 132 of toner cartridge 100 and electrical contacts 242 of imaging unit 200.

Figure 16:
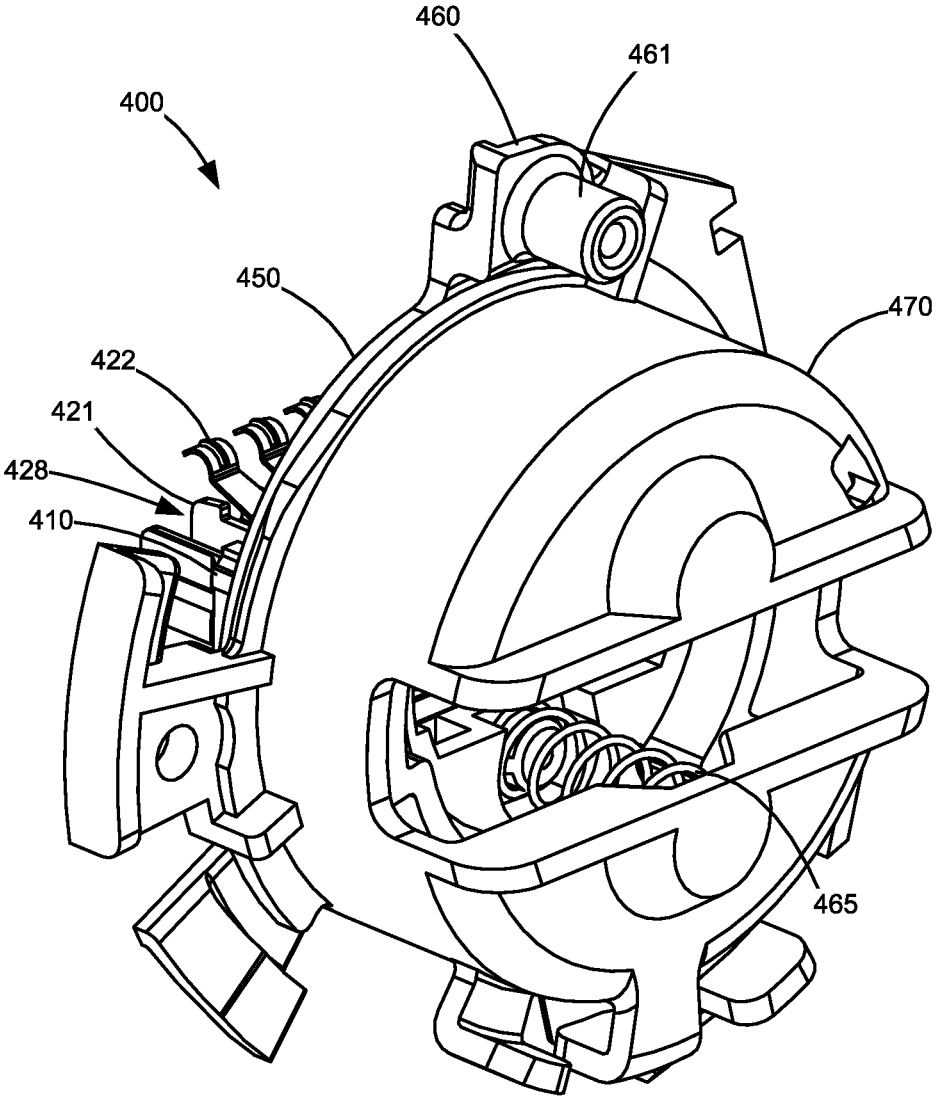
FIG. 16 is an outer side perspective view of the electrical connector assembly according to one example embodiment.
Figure 17:
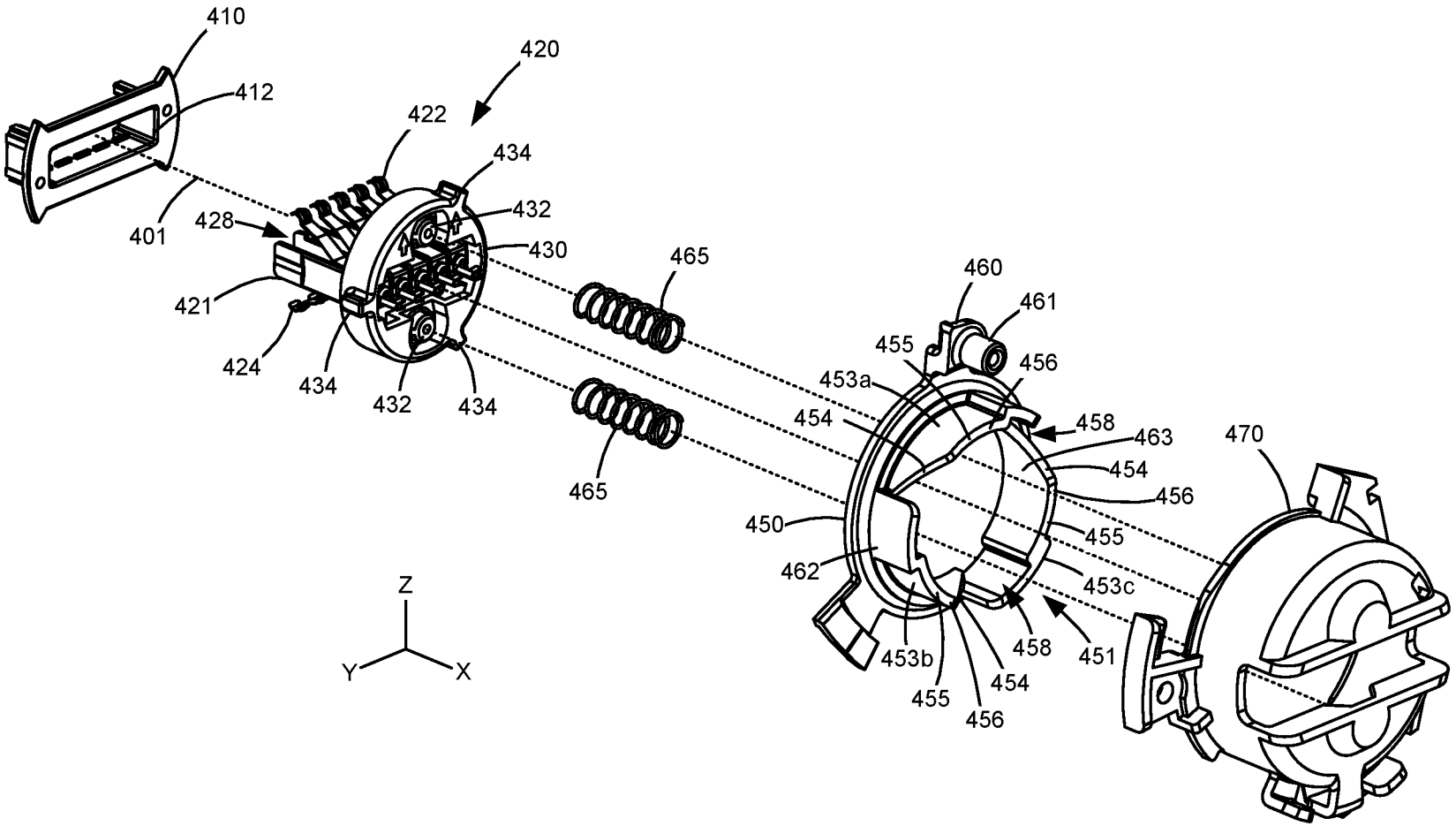
FIG. 17 is an exploded view of the electrical connector assembly according to one example embodiment.
Figure 18:
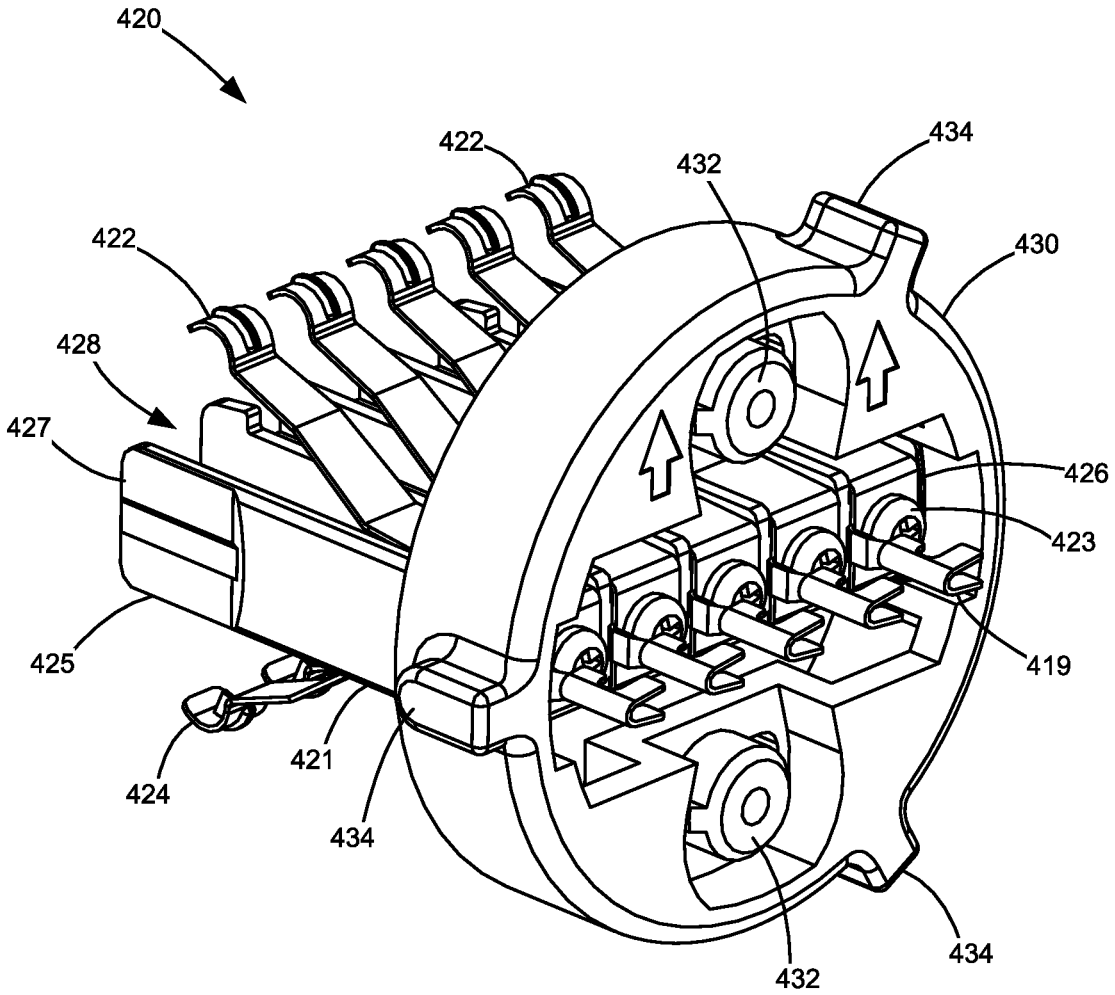
FIG. 18 is a perspective view of a contacts submodule of the electrical connector assembly according to one example embodiment.

FIG. 16 illustrates an outer side perspective view of electrical connector assembly 400 while FIG. 17 illustrates an exploded view thereof. In the embodiment illustrated, electrical connector assembly 400 includes floating track 410, contacts submodule 420, a rotatable camming member 450, and a cap frame 470. In the embodiment illustrated, contacts submodule 420 includes a sleeve mount 430 and a connector block 421 attached to sleeve mount 430. Contacts submodule 420 is also shown in FIG. 18 in greater detail. Connector block 421 of contacts submodule 420 has a first end 425, a second end 426, a divider 429 extending between upper and lower electrical contacts 422, 424 (see FIG. 14), and a plurality of spaced and aligned panels 427 forming open-ended channels 428 (see FIG. 18) between panels 427. First end 425 of connector block 421 extends through and is slidable along a guide opening 412 of floating track 410 with one degree of freedom, parallel to a centerline 401 of electrical connector assembly 400. Second end 426 of connector block 421 forms an interference fit with sleeve mount 430 such that connector block 421 is fixedly attached to and movable together with sleeve mount 430. Divider 429 of connector block 421 electrically isolates electrical contacts 422, 424 from each other. Each channel 428 of connector block 421 is sized to accommodate a corresponding upper or lower electrical contact 422, 424. In one example embodiment, a single metal part is used for each pair of upper and lower electrical contacts 422, 424 such that each pair of upper and lower electrical contacts 422, 424 is connected to a single communications wire. In the embodiment illustrated, connector block 421 holds four pairs of upper electrical contacts 422 and lower electrical contacts 424. In other embodiments, a fewer or greater number of electrical contacts may be used. Each pair of upper and lower electrical contacts 422, 424 has an intermediate portion 423 attached to second end 426 of connector block 421. In the embodiment illustrated, intermediate portion 423 of each pair of upper and lower electrical contacts 422, 424 includes a terminal wire connector 419 used to connect a single communications wire to each pair of upper and lower electrical contacts 422, 424.

Figure 19:
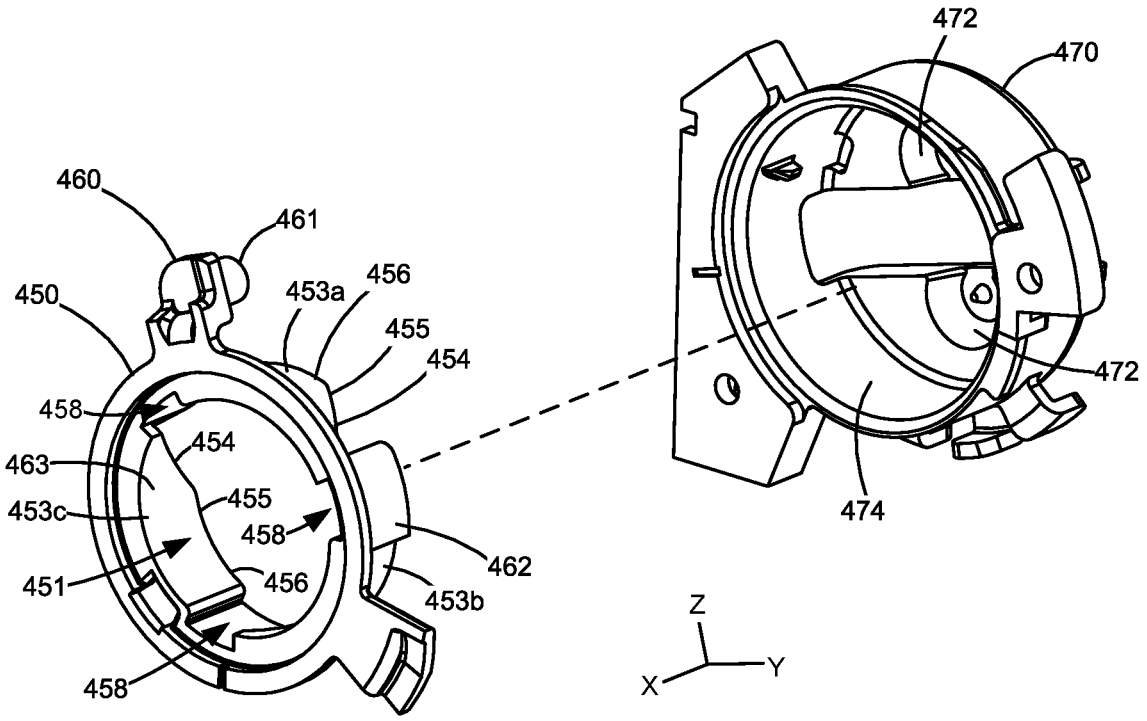
FIG. 19 is an exploded view of a camming member and a cap frame of the electrical connector assembly according to one example embodiment.

Cap frame 470 is mounted on side 302 of imaging forming device 22 and encloses camming member 450 and at least a portion of contacts submodule 420 including sleeve mount 430. An exploded view of camming member 450 relative to cap frame 470 is also illustrated in FIG. 19. One or more biasing members 465 extend through a center opening 451 of camming member 450 and are positioned between cap frame 470 and sleeve mount 430. In the embodiment illustrated, each biasing member 465 is compressed within cap frame 470 between a corresponding spring post 432 on sleeve mount 430 and a corresponding recess 472 on cap frame 470 (FIG. 19) in order to continuously bias sleeve mount 430 axially away from cap frame 470 and toward floating track 410. In the example embodiment illustrated, biasing member 465 includes a compression spring; however, any suitable biasing member 465 may be used as desired, such as, for example, other types of springs or a material having resilient properties.

Cap frame 470 encloses camming member 450 such that camming member 450 is rotatable about centerline 401 within cap frame 470 and relatively floats within cap frame 470. In the embodiment illustrated, camming member 450 includes wall sections 453*a*, 453*b*, 453*c* (generally designated as wall sections 453) each having a corresponding ramp portion 454 and a corresponding dwell portion 455, which together form a cam surface 456. Cam surfaces 456 of camming member 450 are configured to engage corresponding sliding lugs 434 extending radially outward from sleeve mount 430 of contacts submodule 420 when camming member 450 rotates in order to convert rotational motion of camming member 450 into axial motion of contacts submodule 420 as discussed in greater detail below. Wall sections 453 of camming member 450 also define axial channels 458 between cam surfaces 456. When axial channels 458 of camming member 450 are aligned with corresponding sliding lugs 434 of sleeve mount 430, camming member 450 is disengaged from and free from contact with sleeve mount 430. Camming member 450 includes an actuation arm 460 and a post 461 extending from actuation arm 460 for receiving an actuation force to rotate camming member 450 and move contacts submodule 420 between the extended position and the retracted position as discussed in greater detail below.

Defining centerline 401 of electrical connector assembly 400 to be along the X axis, a widthwise dimension of floating track 410 along side 302 of image forming device 22 to be along the Y axis, and with the Z axis being orthogonal to both the X axis and Y axis, floating track 410 when positioned against side 302 of image forming device 22 is closely constrained in the X and Z axes and is movable by a small amount along the Y axis according to one example embodiment.

Figure 20:
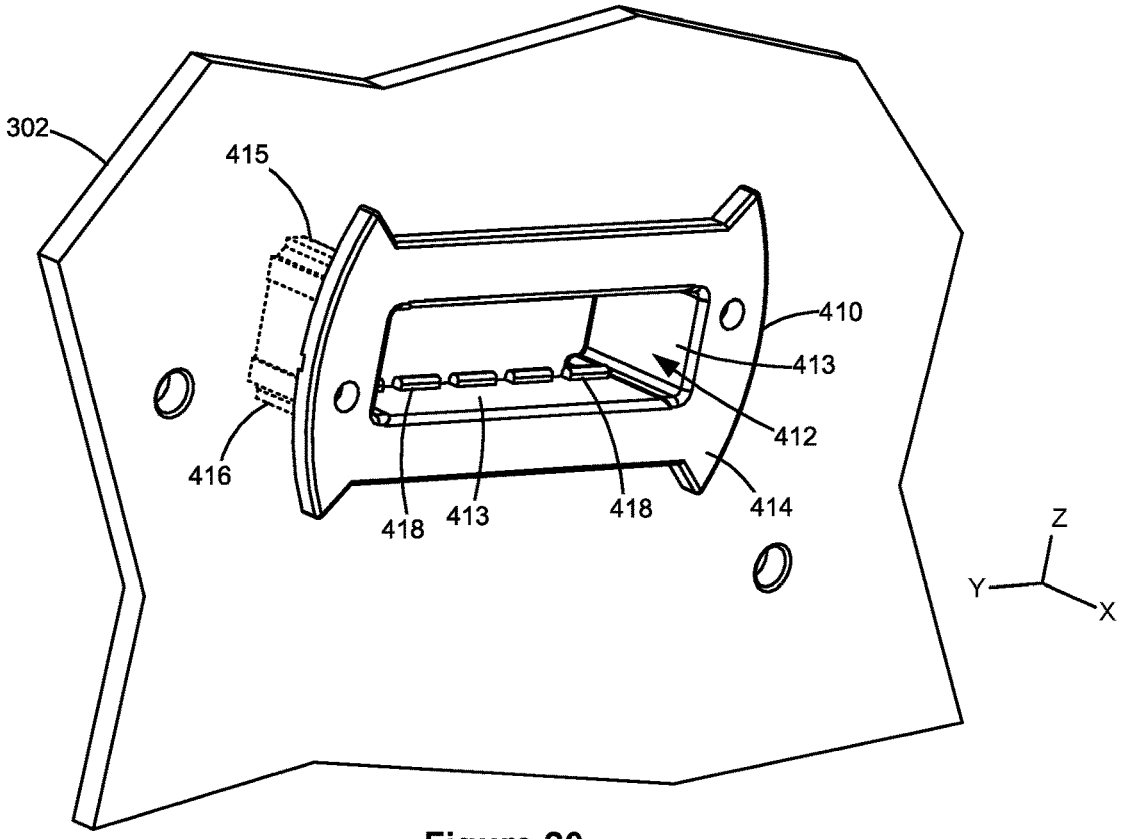
FIG. 20 is an outer side perspective view of a floating track of the electrical connector assembly according to one example embodiment.
Figure 21:
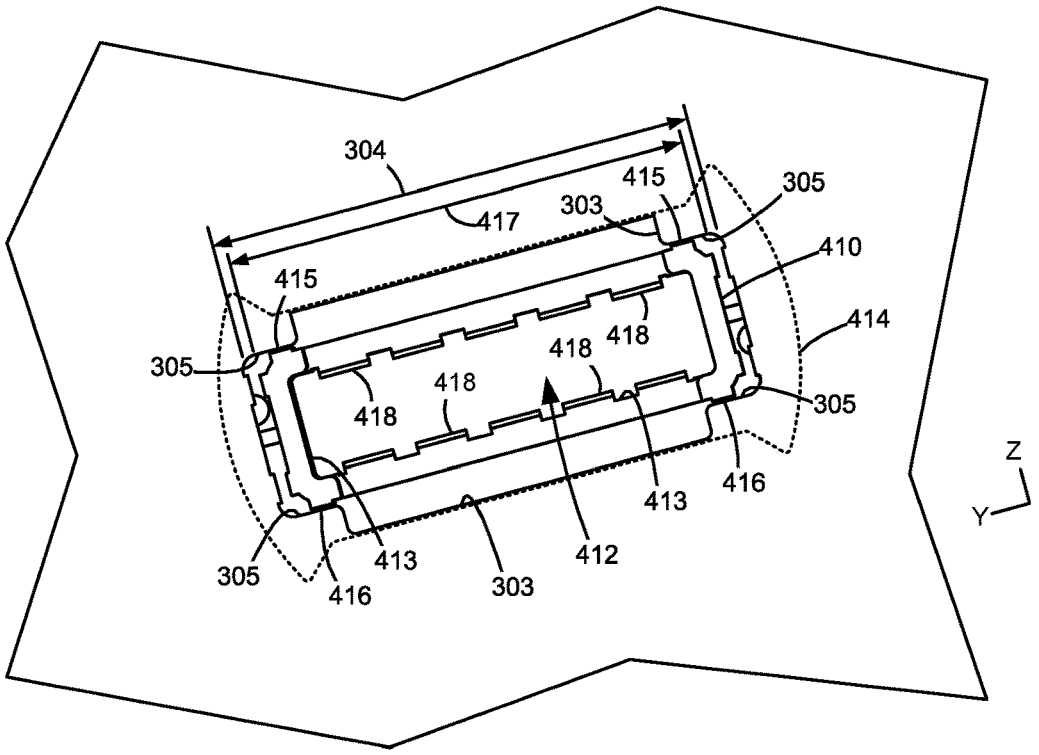
FIG. 21 is an inner side elevation view of the floating track according to one example embodiment.

FIG. 20 is an outer side perspective view illustrating floating track 410 positioned against side 302 of image forming device 22, and FIG. 21 is an inner side elevation view thereof. In the embodiment illustrated, guide opening 412 of floating track 410 is defined by guide walls 413 extending from a side plate 414 (shown in phantom lines in FIG. 21). An aperture 303 on side 302 of image forming device 22 is sized to obstruct side plate 414 and allow guide walls 413 of floating track 410 to pass through aperture 303 and extend toward the loading path of toner cartridge 100 and imaging unit 200. To accommodate for tolerance stackup and/or tolerance variations in the position of electrical connectors 130, 240 of toner cartridge 100 and imaging unit 200 when toner cartridge 100 and imaging unit 200 are installed, the width 304 of aperture 303 on side 302 along the Y axis is greater than a width 417 of the outer edges of guide walls 413 of floating track 410 along the Y axis to provide space for allowing floating track 410 to move laterally in the Y axis direction. Upper lugs 415 and lower lugs 416 extending outward from guide walls 413 of floating track 410 contact inner edges 305 of aperture 303 such that floating track 410 is closely constrained in the Z axis. Side plate 414 of floating track 410 is positioned between cap frame 470 and side 302 of image forming device 22 such that floating track 410 is closely constrained in the X axis.

When connector block 421 of contacts submodule 420 is inserted into guide opening 412 of floating track 410, contacts submodule 420 is movable together with floating track 410 along the Y axis when floating track 410 moves along the Y axis. This arrangement allows the motion of contacts submodule 420 along the Y axis to be tightly constrained by floating track 410 so that contacts submodule 420 is not likely to bind. Since floating track 410 is closely constrained in the X and Z axes, floating track 410 is also not likely to bind when moving along the Y axis.

In the embodiment illustrated, floating track 410 includes restraining tabs 418 protruding inwardly from guide walls 413 within guide opening 412. Restraining tabs 418 are configured to restrain corresponding upper and lower electrical contacts 422, 424 of contacts submodule 420 within floating track 410 to prevent the free ends of upper and lower electrical contacts 422, 424 from catching or stubbing electrical connector 130 of toner cartridge 100 and electrical connector 240 of imaging unit 200 when toner cartridge 100 and imaging unit 200 are inserted into or removed from image forming device 22 while contacts submodule 420 of image forming device 22 is in the retracted position.

Figure 22A:
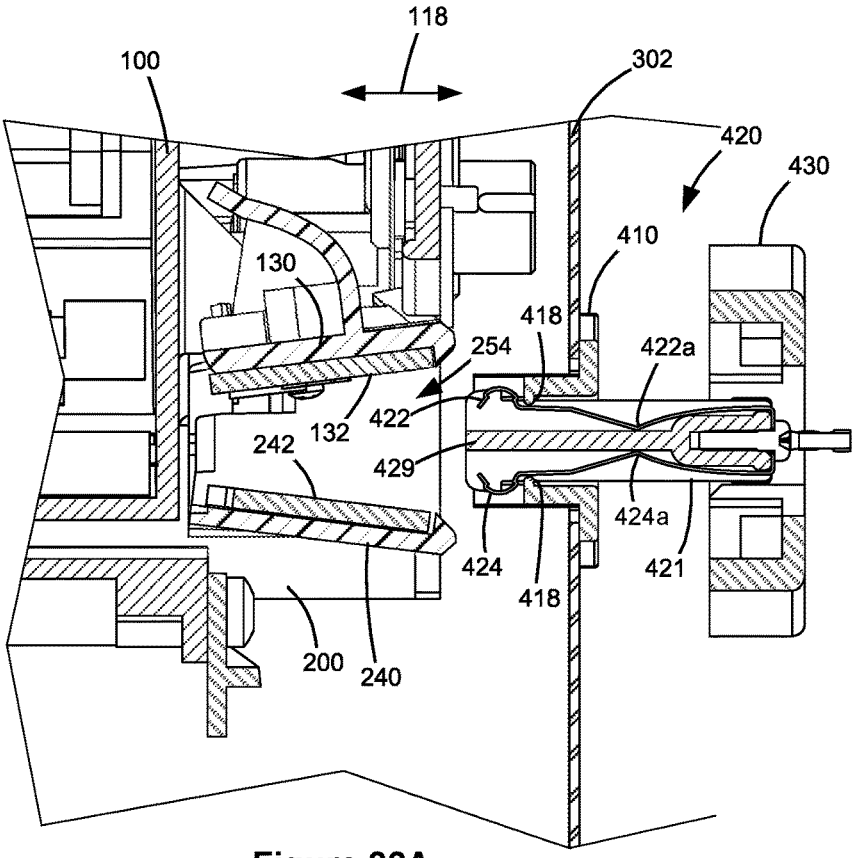
FIGS. 22A and 22B are cross-sectional views showing the electrical connector assembly of the image forming device in a disengaged position and an engaged position, respectively, relative to the electrical connectors of the toner cartridge and imaging unit according to one example embodiment.

FIG. 22A shows toner cartridge 100 installed on imaging unit 200 with toner cartridge 100 and imaging unit 200 installed in image forming device 22 and contacts submodule 420 of image forming device 22 positioned in the retracted position. In this embodiment, contacts submodule 420 of image forming device 22 is spaced outward sideways away from sides 109, 209 of toner cartridge 100 and imaging unit 200 when contacts submodule 420 is in the retracted position. In the embodiment illustrated, each of upper and lower electrical contacts 422, 424 of contacts submodule 420 includes a V-shaped spring that is deflectable about a respective fulcrum 422*a*, 424*a* in contact with divider 429 of connector block 421 extending between each pair of upper and lower electrical contacts 422, 424. Restraining tabs 418 within guide walls 413 of floating track 410 engage corresponding upper and lower electrical contacts 422, 424 of contacts submodule 420 such that upper and lower electrical contacts 422, 424 are deflected inwardly within floating track 410 when contacts submodule 420 is in the retracted position.

Figure 22B:
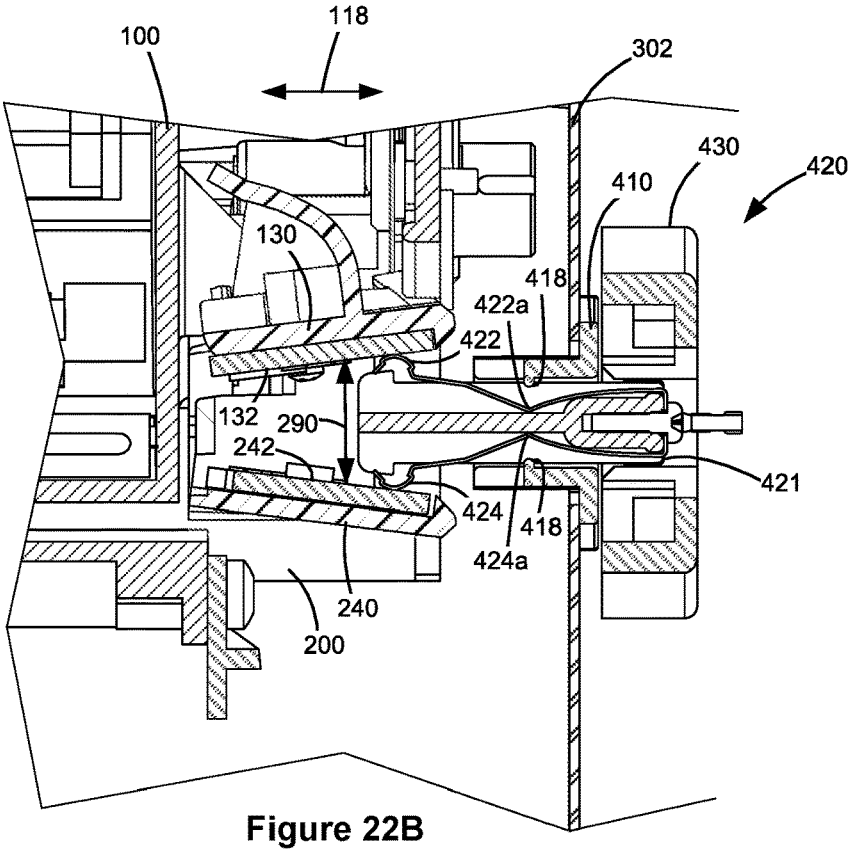

FIG. 22B shows toner cartridge 100 installed on imaging unit 200 with toner cartridge 100 and imaging unit 200 installed in image forming device 22 and contacts submodule 420 of image forming device 22 positioned in the extended position relative to toner cartridge 100 and imaging unit 200. After toner cartridge 100 and imaging unit 200 are mated with each other and installed in image forming device 22, contacts submodule 420 of image forming device 22 moves from the retracted position to the extended position. In the embodiment illustrated, contacts submodule 420 translates along side-to-side dimension 118 of housing 102 toward toner cartridge 100 and imaging unit 200 and along the X-axis when contacts submodule 420 moves from the retracted position to the extended position. As contacts submodule 420 advances toward toner cartridge 100 and imaging unit 200, contacts submodule 420 passes through opening 254 of frame 204 of imaging unit 200 and enters vertical gap 290 between electrical contacts 132 of toner cartridge 100 and electrical contacts 242 of imaging unit 200. In the embodiment illustrated, upper and lower electrical contacts 422, 424 of contacts submodule 420 spring out of contact with the restraining tabs 418 of floating track 410 such that upper electrical contacts 422 flex and spring outward (clockwise as viewed in FIG. 22B) into contact with electrical contacts 132 of toner cartridge 100 and lower electrical contacts 424 flex and spring outward (counterclockwise as viewed in FIG. 22B) into contact with electrical contacts 242 of imaging unit 200 as contacts submodule 420 reaches the extended position.

In one example embodiment, restraining tabs 418 of floating track 410 restrain corresponding upper and lower electrical contacts 422, 424 through most of the motion of contacts submodule 420 from the retracted position to the extended position. For example, restraining tabs 418 are arranged such that upper and lower electrical contacts 422, 424 disengage from corresponding restraining tabs 418 when upper and lower electrical contacts 422, 424 are almost fully inserted into place between electrical connector 130 of toner cartridge 100 and electrical connector 240 of imaging unit 200. Upper and lower electrical contacts 422, 424 of contacts submodule 420 are deflectable and sized to have an interference fit with electrical contacts 132 of toner cartridge 100 and electrical contacts 242 of imaging unit 200, respectively, when contacts submodule 420 reaches the extended position in order to maintain consistent, reliable electrical contact between upper and lower electrical contacts 422, 424 of contacts submodule 420 and corresponding electrical contacts 132 of toner cartridge 100 and electrical contacts 242 of imaging unit 200.

Figure 23:
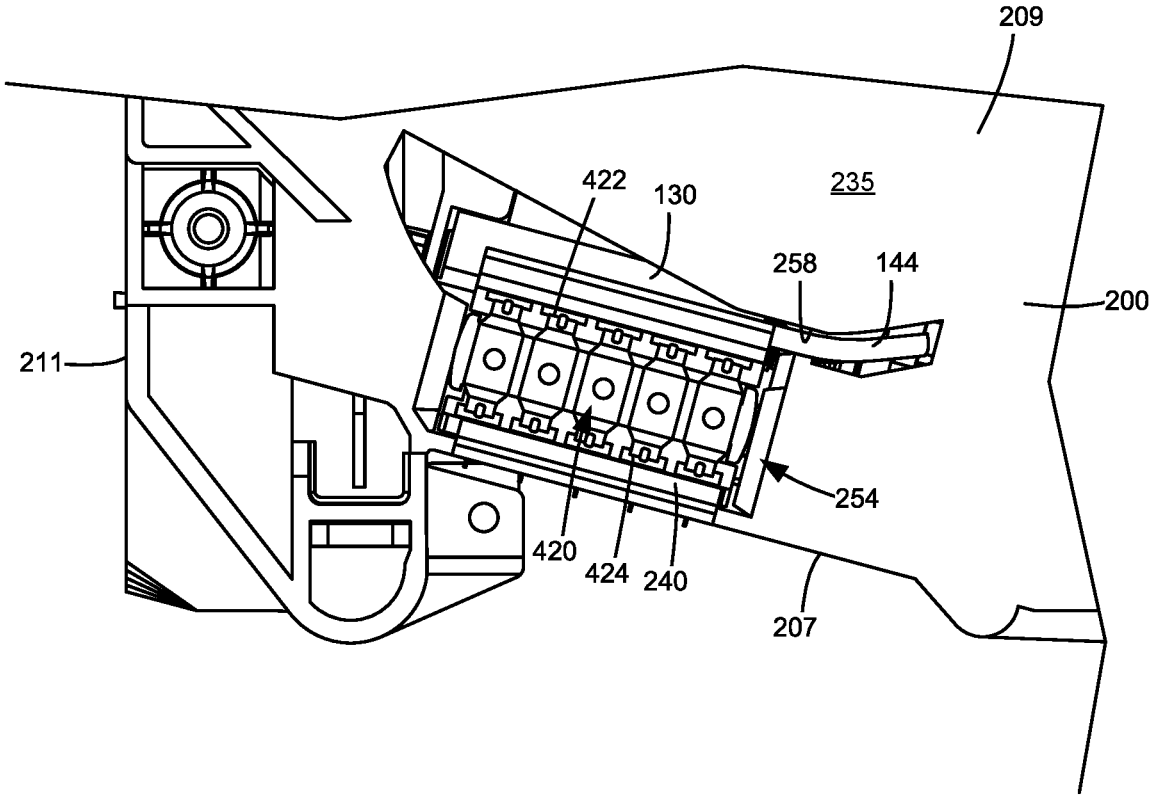
FIG. 23 is a side elevation view showing the electrical connector assembly of the image forming device in the engaged position with the electrical connectors of the toner cartridge and imaging unit according to one example embodiment.

FIG. 23 shows contacts submodule 420 in the extended position passing through opening 254 of imaging unit 200 with upper and lower electrical contacts 422, 424 of contacts submodule 420 in contact with electrical contacts 132 of toner cartridge 100 and electrical contacts 242 of imaging unit 200. In the embodiment illustrated, the upward force applied to electrical connector 130 of toner cartridge 100 by upper electrical contacts 422 of contacts submodule 420 of image forming device 22 pushes an upper surface of electrical connector 130 against upstop 258 of imaging unit 200 in order to limit the upward movement of electrical connector 130. In this embodiment, the upward force applied to electrical contacts 132 of toner cartridge 100 by upper electrical contacts 422 of contacts submodule 420 of image forming device 22 is equal and opposite to the downward force applied to electrical contacts 242 of imaging unit 200 by lower electrical contacts 424 of contacts submodule 420 of image forming device 22. Contact between upstop 258 of imaging unit 200 and the upper surface of electrical connector 130 of toner cartridge 100 results in a downward reaction force on the upper surface of electrical connector 130 of toner cartridge 100 that aids in keeping most of the force from contacts submodule 420 on imaging unit 200, which is firmly positioned in image forming device 22 after installation, instead of on toner cartridge 100. If, instead, upstop 258 of imaging unit 200 was omitted, the upward force on electrical connector 130 of toner cartridge 100 could tend to lift toner cartridge 100 upward relative to imaging unit 200, in turn, reducing the nip force between developer roll 120 and photoconductive drum 220, which could cause print defects. In the embodiment illustrated, upper and lower electrical contacts 422, 424 of contacts submodule 420 push against electrical contacts 132 of toner cartridge 100 and electrical contacts 242 of imaging unit 200 isolated from floating track 410. As a result, the net load applied to toner cartridge 100 and imaging unit 200 by electrical connector assembly 400 of image forming device 22 is substantially minimized.

When contacts submodule 420 of image forming device 22 moves from the extended position to the retracted position, the motion of contacts submodule 420 is reversed. From the position shown in FIG. 22B, contacts submodule 420 of image forming device 22 passes out of opening 254 of imaging unit 200 and moves away from toner cartridge 100 and imaging unit 200, returning to the position shown in FIG. 22A. Upper and lower electrical contacts 422, 424 of contacts submodule 420 return inward (counterclockwise and clockwise, respectively, as viewed in FIG. 22B) within floating track 410 as contacts submodule 420 moves from the extended position to the retracted position.

Referring back to FIGS. 17 and 19, camming member 450 is positioned between floating track 410 and cap frame 470 to move contacts submodule 420 between the retracted position and the extended position. In one embodiment, camming member 450 is slidable by a small amount parallel to the Y-Z plane and perpendicular to the sliding motion of contacts submodule 420 with three degrees of freedom. In the embodiment illustrated, camming member 450 is closely constrained along the X axis and rotatable about the X axis when mounted within cap frame 470. An outer diameter 462 of camming member 450 is loosely constrained against an inner wall 474 of cap frame 470 along the Y and Z axes. An inner diameter 463 of camming member 450 is loosely constrained against sleeve mount 430 of contacts submodule 420 along the Y and Z axes. These loose constraints of camming member 450 relative to cap frame 470 and sleeve mount 430 of contacts submodule 420 along the Y axis and Z axis allow camming member 450 to accommodate movement of contacts submodule 420 and floating track 410 along the Y axis.

Figure 24A:
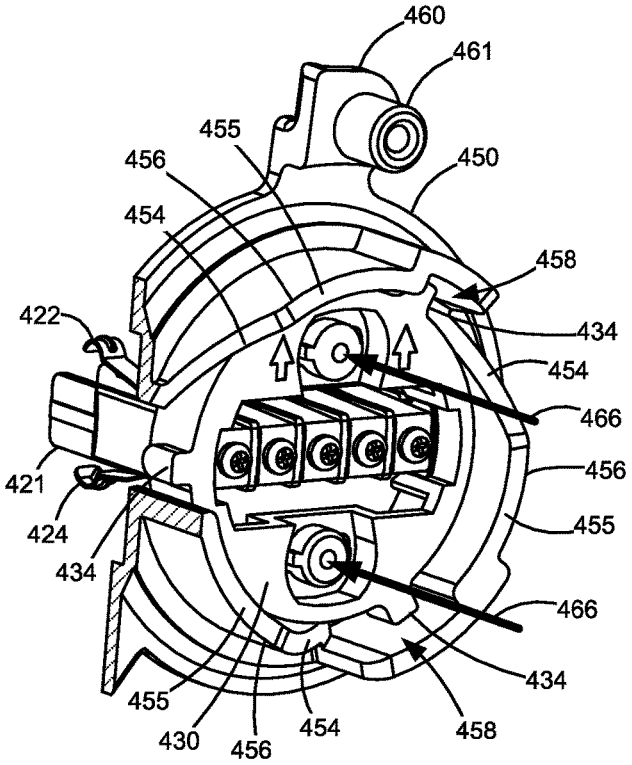
FIGS. 24A-24C are sequential perspective views showing the actuation of the electrical connector assembly of the image forming device from the engaged position to the disengaged position according to one example embodiment.
Figure 24B:
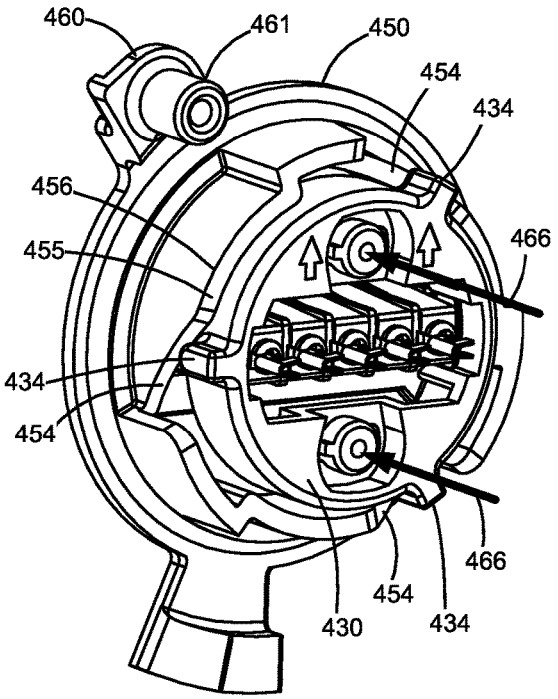
Figure 24C:
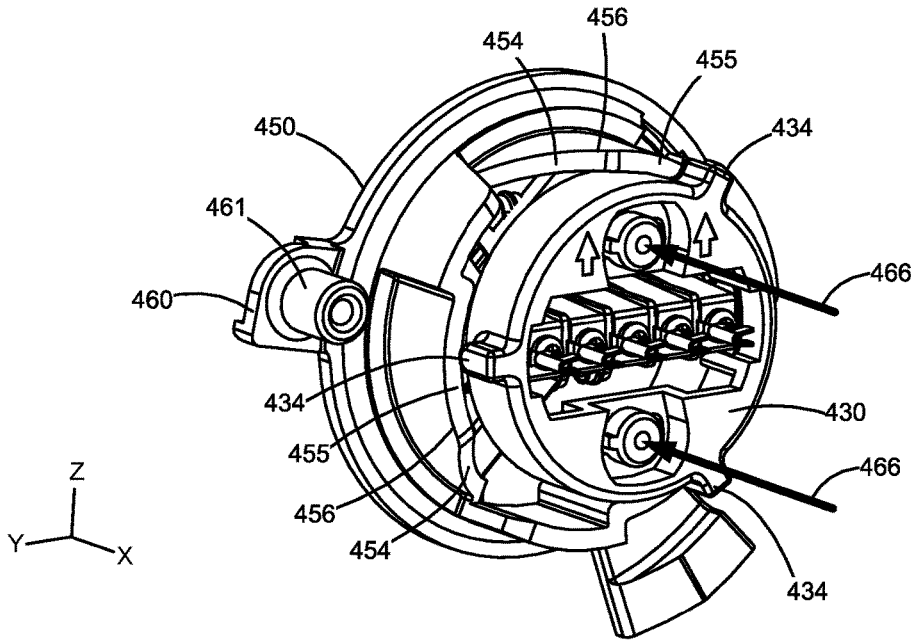

FIGS. 24A-24C are sequential views showing the operation of contacts submodule 420 and camming member 450 of electrical connector assembly 400 when contacts submodule 420 moves from the extended position to the retracted position. In the embodiment illustrated, camming member 450 is rotatable about the X-axis between a first rotational position shown in FIG. 24A and a second rotational position shown in FIG. 24C. Due to the biasing forces 466 applied by biasing members 465 against sleeve mount 430 of contacts submodule 420, sleeve mount 430 is continuously biased along the X axis in a direction towards floating track 410. When camming member 450 is at the first rotational position, axial channels 458 of camming member 450 are aligned with corresponding sliding lugs 434 of sleeve mount 430 such that camming member 450 is free from contact with sleeve mount 430 allowing biasing forces 466 of biasing members 465 to urge contacts submodule 420 against floating track 410 in the extended position corresponding to the position shown in FIGS. 15 and 22B. It is noted that FIG. 24A includes cutaway to show that sliding lug 434 of sleeve mount 430 is free from contact with camming member 450.

FIG. 24B shows camming member 450 being rotated counter-clockwise from the first rotational position, such as upon actuation arm 460 of camming member 450 receiving an actuation force. In the embodiment illustrated, ramp portions 454 of cam surfaces 456 engage corresponding sliding lugs 434 of sleeve mount 430. Biasing forces 466 of biasing members 465 acting against sleeve mount 430 urge sliding lugs 434 of sleeve mount 430 against corresponding ramp portions 454 of camming member 450. Since contacts submodule 420 is constrained by floating track 410 along the Y axis and constrained by camming member 450 along the Z axis, rotational motion of camming member 450 translates into axial motion of contacts submodule 420 along the X axis as camming member 450 rotates counter-clockwise while sliding lugs 434 of sleeve mount 430 of contacts submodule 420 are in contact with corresponding ramp portions 454 of cam surfaces 456 of camming member 450. In particular, when camming member 450 rotates counter-clockwise while sliding lugs 434 of sleeve mount 430 are in contact with corresponding ramp portions 454 of cam surfaces 456 of camming member 450, ramp portions 454 of cam surfaces 456 exert an actuation force on sleeve mount 430 of contacts submodule 420 against the biasing forces 466 of biasing members 465 causing sleeve mount 430 of contacts submodule 420 to move axially in a direction away from floating track 410. The use of sliding lugs 434 of contacts submodule 420 on corresponding cam surfaces 456 of camming member 450 allows contacts submodule 420 to float in the Y-axis direction without introducing rotation about the Y axis or Z axis, which may otherwise cause binding of contacts submodule 420 during movement of contacts submodule 420 toward the retracted position.

Sliding lugs 434 of sleeve mount 430 continue to travel along corresponding ramp portions 454 of cam surfaces 456 away from floating track 410 as camming member 450 further rotates counter-clockwise until sliding lugs 434 reach and travel along corresponding dwell portions 455 of cam surfaces 456 of camming member 450 as shown in FIG. 24C. When sliding lugs 434 of sleeve mount 430 reach corresponding dwell portions 455 of cam surfaces 456, contacts submodule 420 is positioned in the retracted position. In FIG. 24C, camming member 450 is shown at the second rotational position. Biasing forces 466 of biasing members 465 urge sliding lugs 434 of sleeve mount 430 against corresponding dwell portions 455 of cam surfaces 456 such that contacts submodule 420 is retained in the retracted position corresponding to the position shown in FIG. 22A.

When camming member 450 rotates clockwise, such as upon actuation arm 460 receiving a reverse actuation force, the above sequence is reversed. In particular, rotation of camming member 450 from the second rotational position (FIG. 24C) to the first rotational position (FIG. 24A) moves contacts submodule 420 from the retracted position to the extended position. In the embodiment illustrated, from the retracted position of contacts submodule 420 shown in FIG. 24C, sliding lugs 434 of sleeve mount 430 of contacts submodule 420 slide along corresponding dwell portions 455 of cam surfaces 456 of camming member 450 as biasing forces 466 of biasing members 465 push sleeve mount 430 of contacts submodule 420 against cam surfaces 456 of camming member 450 while camming member 450 rotates clockwise from the second rotational position. As camming member 450 further rotates clockwise toward the first rotational position, sliding lugs 434 of sleeve mount 430 slide along corresponding ramp portions 454 of cam surfaces 456 as biasing forces 466 of biasing members 465 continue to push sleeve mount 430 against cam surfaces 456 of camming member 450 causing sleeve mount 430 of contacts submodule 420 to move along the X axis towards floating track 410. When camming member 450 approaches the first rotational position, sliding lugs 434 of sleeve mount 430 slide off of corresponding ramp portions 454 of cam surfaces 456 and align with corresponding axial channels 458 of camming member 450 as shown in FIG. 24A. When camming member 450 is at the first rotational position, sleeve mount 430 is free from contact with camming member 450 allowing biasing forces 466 of biasing members 465 to urge sleeve mount 430 of contacts submodule 420 against floating track 410 and bias contacts submodule 420 in the extended position. In one embodiment, sliding lugs 434 of sleeve mount 430 of contacts submodule 420 are configured to come out of contact with camming member 450 just prior to upper and lower electrical contacts 422, 424 of contacts submodule 420 engaging electrical contacts 132 of toner cartridge 100 and electrical contacts 242 of imaging unit 200 as contacts module 420 approaches the extended position.

Figure 25:
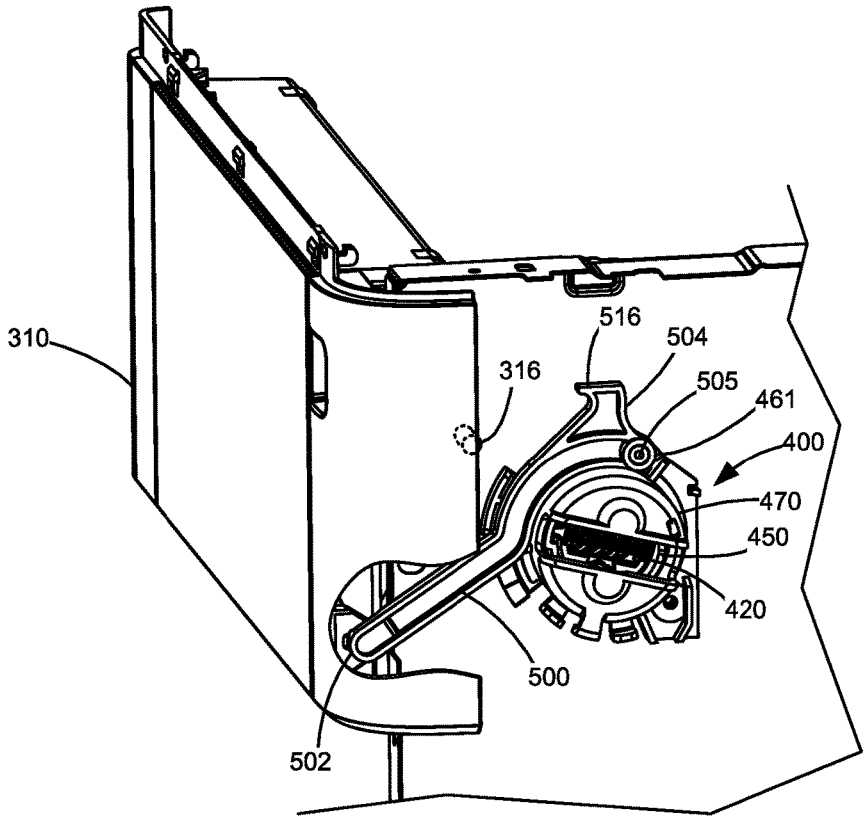
FIG. 25 is a perspective view showing a linkage connected between the electrical connector assembly and an access door of the image forming device with the access door in a closed position according to one example embodiment.
Figure 26:
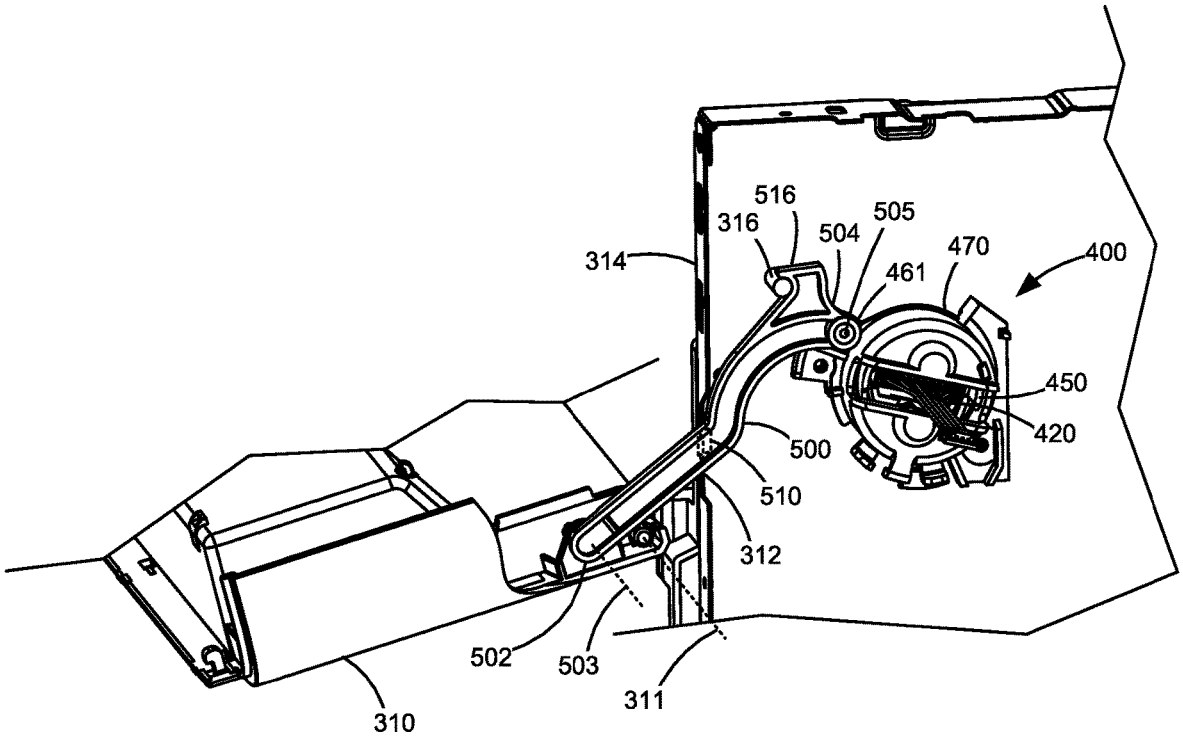
FIG. 26 is a perspective view showing the linkage, the electrical connector assembly, and the access door with the access door in an open position according to one example embodiment.
Figure 27:
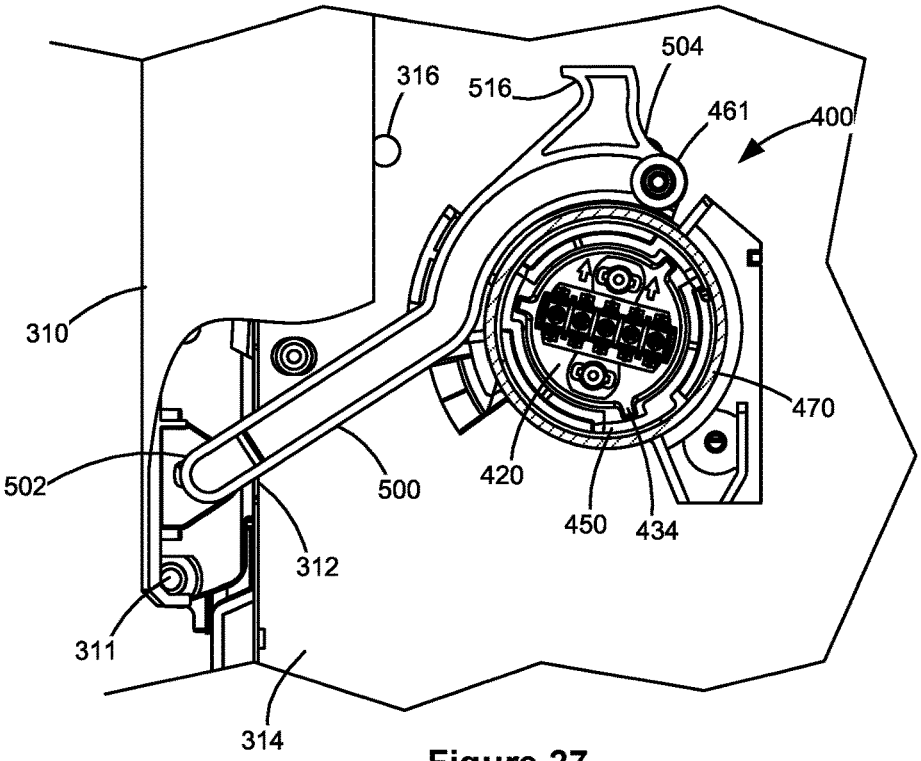
FIG. 27 is a side elevation view of FIG. 25 with a portion of the cap frame cut away to show the camming member and the contacts submodule according to one example embodiment.
Figure 28:
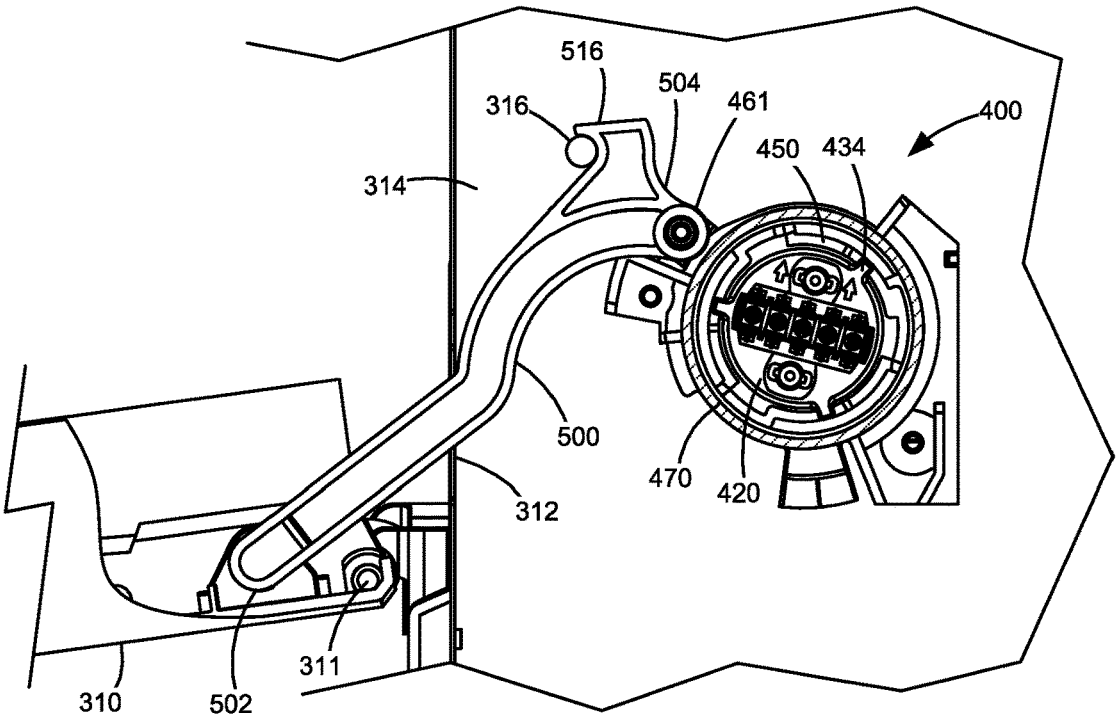
FIG. 28 is a side elevation view of FIG. 26 with a portion of the cap frame cut away to show the camming member and the contacts submodule according to one example embodiment.

With reference to FIGS. 25-28, camming member 450 of electrical connector assembly 400 is actuated by a linkage 500 connected to access door 310. FIGS. 25 and 26 are perspective views showing access door 310 in a closed position and an open position, respectively. FIGS. 27 and 28 are side elevation views showing access door 310 in the closed position and the open position, respectively, with a portion of cap frame 470 cut away to show camming member 450 and contacts submodule 420 of electrical connector assembly 400.

Linkage 500 is connected between access door 310 and electrical connector assembly 400 such that closing access door 310 moves contacts submodule 420 of electrical connector assembly 400 from the retracted position to the extended position and opening access door 310 moves contacts submodule 420 from the extended position to the retracted position In the embodiment illustrated, linkage 500 has a first end 502 operatively connected to access door 310 and a second end 504 operatively connected to post 461 of camming member 450 of electrical connector assembly 400. Linkage 500 allows the opening motion of access door 310 to rotate camming member 450 of electrical connector assembly 400 from the first rotational position (FIGS. 24A and 25) to the second rotational position (FIGS. 24C and 26) when access door 310 pivots about a pivot axis 311 from the closed position to the open position in order to move contacts submodule 420 of electrical connector assembly 400 from the extended position to the retracted position. Conversely, linkage 500 allows the closing motion of access door 310 to rotate camming member 450 of electrical connector assembly 400 from the second rotational position to the first rotational position when access door 310 pivots about pivot axis 311 from the open position to the closed position in order to move contacts submodule 420 of electrical connector assembly 400 from the retracted position to the extended position.

In the embodiment illustrated, linkage 500 supports access door 310 at a fixed angle when access door 310 is in the open position. The position of linkage 500 is controlled such that linkage 500 sets the angular position of access door 310 in the open position. In the embodiment illustrated, linkage 500 includes a brace feature 510 (shown in phantom lines in FIG. 26) that aligns with a wall 312 on a frame 314 of image forming device 22 so that the weight of access door 310 is supported by frame 314 rather than electrical connector assembly 400 when access door 310 is in the open position. For brace feature 510 to align with frame 314, the position of linkage 500 is set such that a pivot point 503 of first end 502 of linkage 500 is pinned to access door 310 and a pivot point 505 of second end 504 of linkage 500 is connected to the camming member 450.

Since camming member 450 of electrical connector assembly 400 floats relative to cap frame 470 as discussed above, a fixed point in image forming device 22 is provided to align linkage 500 in a specific location and orientation when access door 310 is in the open position. In the embodiment illustrated, linkage 500 includes a hook 516 that engages a post 316 on frame 314 of image forming device 22 when access door 310 is opened. Engagement between hook 516 of linkage 500 and post 316 on frame 314 when access door 310 is opened allows linkage 500 to pivot about post 316 until brace feature 510 engages wall 312 of frame 314 as access door 310 is fully opened. When brace feature 510 engages wall 312 of frame 314, camming member 450 is positioned in the second rotational position and contacts submodule 420 is positioned in the retracted position. In this position, camming member 450 is constrained in the second rotational position by linkage 500. In this manner, camming member 450 transitions between a floating position when access door 310 is closing to being constrained when access door 310 is fully opened.

When access door 310 is closed, hook 516 of linkage 500 disengages from post 316 on frame 314 as access door 310 pushes linkage 500 when access door 310 moves from the open position to the closed position causing linkage 500 to rotate camming member 450 from the second rotational position to the first rotational position. When access door 310 is in the closed position, first end 502 of linkage 500 is pinned to a fixed location at pivot point 503 on access door 310 and second end 504 of linkage 500 connected to camming member 450 is constrained to an arc, as shown in FIGS. 25 and 27. In this position, sliding lugs 434 are disengaged from camming member 450 such that camming member 450 does not influence the position of contacts submodule 420.

In order to account for improperly positioned assembly of toner cartridge 100 and imaging unit 200 within image forming device 22, such as when a user fails to fully seat toner cartridge 100 and imaging unit 200 in their final operating positions within image forming device 22 before closing access door 310, access door 310 is configured to force toner cartridge 100 and imaging unit 200 to be seated all the way into their final operating positions within image forming device 22 as access door 310 is closed. This allows for contacts submodule 420 of image forming device 200 to align with vertical gap 290 between electrical contacts 132 of toner cartridge 100 and electrical contacts 242 of imaging unit 200 before access door 310 reaches its final closed position. In one embodiment, access door 310 includes bumpers that are positioned to engage toner cartridge 100 and/or imaging unit 200 to fully seat toner cartridge 100 and imaging unit 200 in their final operating positions as access door 310 is closed.

It will be appreciated that the configuration of electrical connector 130 of toner cartridge 100 including the motion of electrical connector 130 between the retracted position and the operative position is not limited to the example embodiment illustrated. For example, the embodiment illustrated includes an electrical connector 130 that pivots between the retracted position and the operative position about a fixed pivot axis 134. However, in other embodiments, the location of the pivot axis of the electrical connector of the toner cartridge moves relative to the housing of the toner cartridge as the electrical connector of the toner cartridge pivots between the retracted position and the operative position.

Further, the embodiment illustrated includes a rigid electrical connector 130 including electrical contacts 132 positioned on a rigid printed circuit board 138. However, in other embodiments, the electrical contacts of the electrical connector of the toner cartridge are flexible relative to the housing of the toner cartridge permitting the electrical contacts to flex between the retracted position and the operative position. For example, the electrical contacts of the electrical connector of the toner cartridge may be formed on a flexible printed circuit board or the electrical contacts may be electrically connected to a printed circuit board mounted elsewhere on the housing of the toner cartridge and positioned on or connected to a flexible substrate other than the printed circuit board.

Further, while the embodiment illustrated includes an electrical connector 130 of toner cartridge 100 that pivots between the retracted position and the operative position, it will be appreciated that the electrical connector of the toner cartridge may move in other manners relative to the housing of the toner cartridge between the retracted position and the operative position, such as, for example, translating between the retracted position and the operative position.

It will also be appreciated that imaging unit 200 may include one or more actuation or cam features modified relative to cam surface 256 of the example embodiment illustrated as desired in order to actuate the electrical connector of the toner cartridge from the retracted position to the operative position during installation of the toner cartridge onto the imaging unit. Alternatively, the electrical connector of the toner cartridge may be actuated by other means, such as, for example, by a linkage actuated by the opening and closing of the access door of the image forming device or by a user-actuated mechanism.

While the example embodiment illustrated includes toner cartridge 100 having a movable electrical connector 130 and imaging unit 200 having an actuation member that moves electrical connector 130 from its retracted position to its operative position during installation of toner cartridge 100 onto imaging unit 200, this configuration may be reversed as desired such that the imaging unit includes a movable electrical connector and the toner cartridge includes an actuation member that moves the electrical connector from a retracted position to an operative position during mating of the toner cartridge with the imaging unit.

Although the example embodiment discussed above includes a pair of replaceable units in the form of a toner cartridge 100 that includes the main toner supply for the image forming device and the developer unit and an imaging unit 200 that includes the photoconductor unit for each toner color, it will be appreciated that the replaceable unit(s) of the image forming device may employ any suitable configuration as desired. For example, in one embodiment, the main toner supply for the image forming device is provided in a first replaceable unit and the developer unit and photoconductor unit are provided in a second replaceable unit. In another embodiment, the main toner supply for the image forming device, the developer unit and the photoconductor unit are provided in a single replaceable unit. Other configurations may be used as desired.

Further, it will be appreciated that the architecture and shape of toner cartridge 100 and imaging unit 200 illustrated in FIGS. 2-6 is merely intended to serve as an example. Those skilled in the art understand that toner cartridges, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An assembly for an electrophotographic image forming device, comprising:

an access door movable between an open position permitting user replacement of a replaceable unit of the image forming device and a closed position; and an electrical connector mounted in the image forming device, the electrical connector is movable relative to a frame of the image forming device between a retracted position and an extended position, in the retracted position the electrical connector is disengaged from a corresponding electrical connector of the replaceable unit when the replaceable unit is installed in the image forming device, in the extended position the electrical connector is engaged with the corresponding electrical connector of the replaceable unit when the replaceable unit is installed in the image forming device, wherein the electrical connector is operatively connected to the access door of the image forming device such that movement of the access door from the closed position to the open position moves the electrical connector from the extended position to the retracted position and movement of the access door from the open position to the closed position moves the electrical connector from the retracted position to the extended position, wherein the electrical connector translates along a first direction when the electrical connector moves between the retracted position and the extended position as the access door moves between the open position and the closed position.

2. The assembly of claim 1, wherein the electrical connector is translatable along a second direction orthogonal to the first direction during movement of the electrical connector along the first direction between the retracted position and the extended position.

3. The assembly of claim 2, wherein movement of the electrical connector is constrained along a third direction orthogonal to the first and second directions during movement of the electrical connector along the first direction between the retracted position and the extended position.

4. An assembly for an electrophotographic image forming device, comprising:

an access door movable between an open position permitting user replacement of a replaceable unit of the image forming device and a closed position;

an electrical connector mounted in the image forming device, the electrical connector is movable relative to a frame of the image forming device between a retracted position and an extended position, in the retracted position the electrical connector is disengaged from a corresponding electrical connector of the replaceable unit when the replaceable unit is installed in the image forming device, in the extended position the electrical connector is engaged with the corresponding electrical connector of the replaceable unit when the replaceable unit is installed in the image forming device; and a camming member rotatable between a first rotational position and a second rotational position, the camming member is operatively connected to the electrical connector and to the access door such that movement of the access door from the closed position to the open position rotates the camming member from the first rotational position to the second rotational position which moves the electrical connector from the extended position to the retracted position and movement of the access door from the open position to the closed position rotates the camming member from the second rotational position to the first rotational position which moves the electrical connector from the retracted position to the extended position.

5. The assembly of claim 4, further comprising a linkage operatively connected between the access door and the camming member such that the linkage moves the camming member between the first rotational position and the second rotational position as the access door moves between the closed position and the open position.

6. The assembly of claim 4, wherein the camming member is disengaged from the electrical connector when the camming member is in the first rotational position while the access door is in the closed position such that the camming member applies no force against the electrical connector when the electrical connector is engaged with the corresponding electrical connector of the replaceable unit when the electrical connector is in the extended position.

7. The assembly of claim 4, wherein the electrical connector translates along a first direction when the electrical connector moves between the retracted position and the extended position as the access door moves between the open position and the closed position.

8. The assembly of claim 7, wherein the electrical connector is translatable along a second direction orthogonal to the first direction during movement of the electrical connector along the first direction between the retracted position and the extended position.

9. The assembly of claim 8, wherein movement of the electrical connector is constrained along a third direction orthogonal to the first and second directions during movement of the electrical connector along the first direction between the retracted position and the extended position.

10. The assembly of claim 7, wherein the camming member is rotatable about a rotational axis parallel to the first direction.

11. The assembly of claim 10, wherein the camming member is movable along a plane orthogonal to the first direction during rotation of the camming member about the rotational axis between the first rotational position and the second rotational position.

12. The assembly of claim 7, wherein movement of the camming member is constrained along the first direction.

13. An assembly for an electrophotographic image forming device, comprising:

an access door movable between an open position permitting user replacement of a first replaceable unit and a second replaceable unit of the image forming device and a closed position; and an electrical connector mounted in the image forming device, the electrical connector is movable relative to a frame of the image forming device between a retracted position and an extended position, in the retracted position the electrical connector is disengaged from a first corresponding electrical connector of the first replaceable unit and a second corresponding electrical connector of the second replaceable unit when the first and second replaceable units are installed in the image forming device, in the extended position the electrical connector is engaged with the first corresponding electrical connector of the first replaceable unit and the second corresponding electrical connector of the second replaceable unit when the first and second replaceable units are installed in the image forming device, wherein the electrical connector is operatively connected to the access door of the image forming device such that movement of the access door from the closed position to the open position moves the electrical connector from the extended position to the retracted position and movement of the access door from the open position to the closed position moves the electrical connector from the retracted position to the extended position, further comprising a camming member rotatable between a first rotational position and a second rotational position, the camming member is operatively connected to the electrical connector and to the access door such that movement of the access door from the closed position to the open position rotates the camming member from the first rotational position to the second rotational position which moves the electrical connector from the extended position to the retracted position and movement of the access door from the open position to the closed position rotates the camming member from the second rotational position to the first rotational position which moves the electrical connector from the retracted position to the extended position.

14. The assembly of claim 13, further comprising a linkage operatively connected between the access door and the camming member such that the linkage moves the camming member between the first rotational position and the second rotational position as the access door moves between the closed position and the open position.

15. The assembly of claim 13, wherein the camming member is disengaged from the electrical connector when the camming member is in the first rotational position while the access door is in the closed position such that the camming member applies no force against the electrical connector when the electrical connector is engaged with the first corresponding electrical connector of the first replaceable unit and the second corresponding electrical connector of the second replaceable unit and the electrical connector is in the extended position.

16. An assembly for an electrophotographic image forming device, comprising:

an access door movable between an open position permitting user replacement of a first replaceable unit and a second replaceable unit of the image forming device and a closed position; and an electrical connector mounted in the image forming device, the electrical connector is movable relative to a frame of the image forming device between a retracted position and an extended position, in the retracted position the electrical connector is disengaged from a first corresponding electrical connector of the first replaceable unit and a second corresponding electrical connector of the second replaceable unit when the first and second replaceable units are installed in the image forming device, in the extended position the electrical connector is engaged with the first corresponding electrical connector of the first replaceable unit and the second corresponding electrical connector of the second replaceable unit when the first and second replaceable units are installed in the image forming device, wherein the electrical connector is operatively connected to the access door of the image forming device such that movement of the access door from the closed position to the open position moves the electrical connector from the extended position to the retracted position and movement of the access door from the open position to the closed position moves the electrical connector from the retracted position to the extended position, wherein the electrical connector translates along a first direction when the electrical connector moves between the retracted position and the extended position as the access door moves between the open position and the closed position.

17. The assembly of claim 16, wherein the electrical connector is translatable along a second direction orthogonal to the first direction during movement of the electrical connector along the first direction between the retracted position and the extended position.

18. The assembly of claim 17, wherein movement of the electrical connector is constrained along a third direction orthogonal to the first and second directions during movement of the electrical connector along the first direction between the retracted position and the extended position.

* * * * *